US010119763B2

(12) United States Patent
Yu

(10) Patent No.: US 10,119,763 B2
(45) Date of Patent: Nov. 6, 2018

(54) APPARATUS FOR FEEDING RAW MATERIAL BARS TO A MELTING FURNACE

(71) Applicant: Chai-Long Yu, Taichung (TW)

(72) Inventor: Chai-Long Yu, Taichung (TW)

( * ) Notice: Subject to any disclaimer, the term of this patent is extended or adjusted under 35 U.S.C. 154(b) by 403 days.

(21) Appl. No.: 14/933,519

(22) Filed: Nov. 5, 2015

(65) Prior Publication Data

US 2016/0348972 A1 Dec. 1, 2016

(30) Foreign Application Priority Data

May 25, 2015 (TW) ..... 104116673 A

(51) Int. Cl.
*F27D 3/04* (2006.01)
*F27D 3/08* (2006.01)
*F27D 3/00* (2006.01)

(52) U.S. Cl.
CPC ..... *F27D 3/08* (2013.01); *F27D 3/0025* (2013.01); *F27D 3/0033* (2013.01); *F27D 3/04* (2013.01); *F27D 2003/0012* (2013.01); *F27D 2003/0014* (2013.01); *F27D 2003/0015* (2013.01)

(58) Field of Classification Search
CPC ..... F27D 3/04
USPC ..... 414/173
See application file for complete search history.

(56) References Cited

U.S. PATENT DOCUMENTS 3,836,325 A * 9/1974 Nakamura ..... C21D 9/0018 219/654
4,302,143 A * 11/1981 Grimminger ..... B01J 3/02 414/173
4,581,063 A * 4/1986 Oyabu ..... F27B 3/045 266/200
5,226,774 A * 7/1993 Tutt ..... F23G 5/20 414/149
5,643,528 A 7/1997 Le Gras
(Continued)

FOREIGN PATENT DOCUMENTS

CN 2459794 Y 11/2001
DE 3400903 A1 7/1984
(Continued)

OTHER PUBLICATIONS

European Search Report dated Sep. 1, 2016 in corresponding EP Application No. 15194515.1, 7 pages.
(Continued)

*Primary Examiner* — Jonathan Snelting
(74) *Attorney, Agent, or Firm* — Faegre Baker Daniels LLP

(57) ABSTRACT

An apparatus feeds raw material bars to a furnace body of a melting furnace, and includes an enclosure body provided with a vertical feed passage to be disposed above an open top side of the furnace body. A feeding unit includes a push mechanism extending into an upper part of the feed passage, and a material retarder extending into a lower part of the feed passage. A transferring unit transfers a raw material bar to the feed passage in a manner that the raw material bar extends vertically in the feed passage. The push mechanism pushes the raw material bar in the feed passage downwardly, and the material retarder retards downward movement of the raw material bar out of the feed passage and into the furnace body.

20 Claims, 27 Drawing Sheets

(56) References Cited

U.S. PATENT DOCUMENTS

| | | | | |
|---|---|---|---|---|
| 6,336,809 | B1 * | 1/2002 | Crafton | B22D 29/003 164/131 |
| 7,021,361 | B2 | 4/2006 | Hara | |
| 2002/0062940 | A1 | 5/2002 | Katoh | |
| 2014/0054832 | A1 | 2/2014 | Yu | |

FOREIGN PATENT DOCUMENTS

| | | | |
|---|---|---|---|
| JP | H0771880 | A | 3/1995 |
| JP | H09-155526 | A | 6/1997 |
| JP | 2001300712 | A | 10/2001 |
| JP | 2002224812 | A | 8/2002 |
| TW | 200406269 | A | 5/2004 |
| TW | M444231 | U1 | 1/2013 |

OTHER PUBLICATIONS

English Translation of Search Report of Taiwan Patent Application No. 104116673, dated May 25, 2015, 2 pages.

* cited by examiner

APPARATUS FOR FEEDING RAW MATERIAL BARS TO A MELTING FURNACE

CROSS-REFERENCE TO RELATED APPLICATION

This application claims priority of Taiwanese Patent Application No. 104116673, filed on May 25, 2015, the entire disclosure of which is hereby expressly incorporated herein by reference.

FIELD

The disclosure relates to a feed apparatus, and more particularly to an apparatus for feeding raw material bars to a melting furnace.

BACKGROUND

FIG. 1 illustrates a molten metal feed apparatus disclosed in U.S. Pat. No. 7,021,361. The feed apparatus is used to feed molten metal to a die casting machine 11, and includes a ladle 12 for holding molten metal, and a conveyor system 13 for conveying the ladle 12 to a feed position of the die casting machine 11 and for tilting the ladle 12 to pour the molten metal into the die casting machine 11. Since an open space design of the feed apparatus does not favor preservation of the temperature of the molten metal, constant heating is required, which leads to high energy consumption. Furthermore, the temperature of the molten metal drops considerably and the molten metal may oxidize while the molten metal is being conveyed, which may result in defects during the die casting operation that can reduce the production yield.

FIGS. 2 and 3 illustrate an aluminum-based material melting apparatus disclosed in U.S. Patent Application Publication No. 2014/0054832. The apparatus includes a furnace unit 2 and a feed unit 3. The furnace unit 2 includes a closed furnace 21 in spatial communication with the feed unit 3. The feed unit 3 includes a feed hopper 31 for receiving particulate aluminum-based raw material, a pre-heating funnel 32, a valve mechanism 33 provided between the feed hopper 31 and the pre-heating funnel 32, and a conveying unit 34. When the weight of the particulate raw material becomes sufficient, the valve mechanism 33 changes to an open state, thereby permitting passage of the raw material into the pre-heating funnel 32. The raw material is conveyed from the pre-heating funnel 32 to the closed furnace 21 via the conveying unit 34, and is heated for melting in the closed furnace 21.

However, the melting apparatus requires pre-processing of the raw material into particulate form. Moreover, the design of the valve mechanism 33 may lead to a large amount of the raw material being fed at once, which may reduce and does not favor preservation of the temperature of the melting operation. Frequent reheating may be needed, which increases energy consumption.

SUMMARY

An object of the disclosure is to provide an apparatus for feeding raw material bars to a melting furnace.

An apparatus according to the disclosure is for feeding raw material bars to a furnace body of a melting furnace and includes:

an enclosure body provided with a feed passage that extends vertically and that is to be disposed above an open top side of the furnace body;

a feeding unit including a push mechanism that extends vertically into an upper part of the feed passage, and a material retarder that extends into a lower part of the feed passage; and a transferring unit disposed at the enclosure body and configured to transfer a raw material bar to the feed passage in a manner that the raw material bar extends vertically in the feed passage with the push mechanism being disposed above the raw material bar and with the raw material bar contacting the material retarder.

The push mechanism is operable to push the raw material bar in the feed passage downwardly, and the material retarder is configured to retard downward movement of the raw material bar out of the feed passage and into the furnace body.

BRIEF DESCRIPTION OF THE DRAWINGS

Other features and advantages of the disclosure will become apparent in the following detailed description of an embodiment with reference to the accompanying drawings, of which.

DETAILED DESCRIPTION

Figure 1:
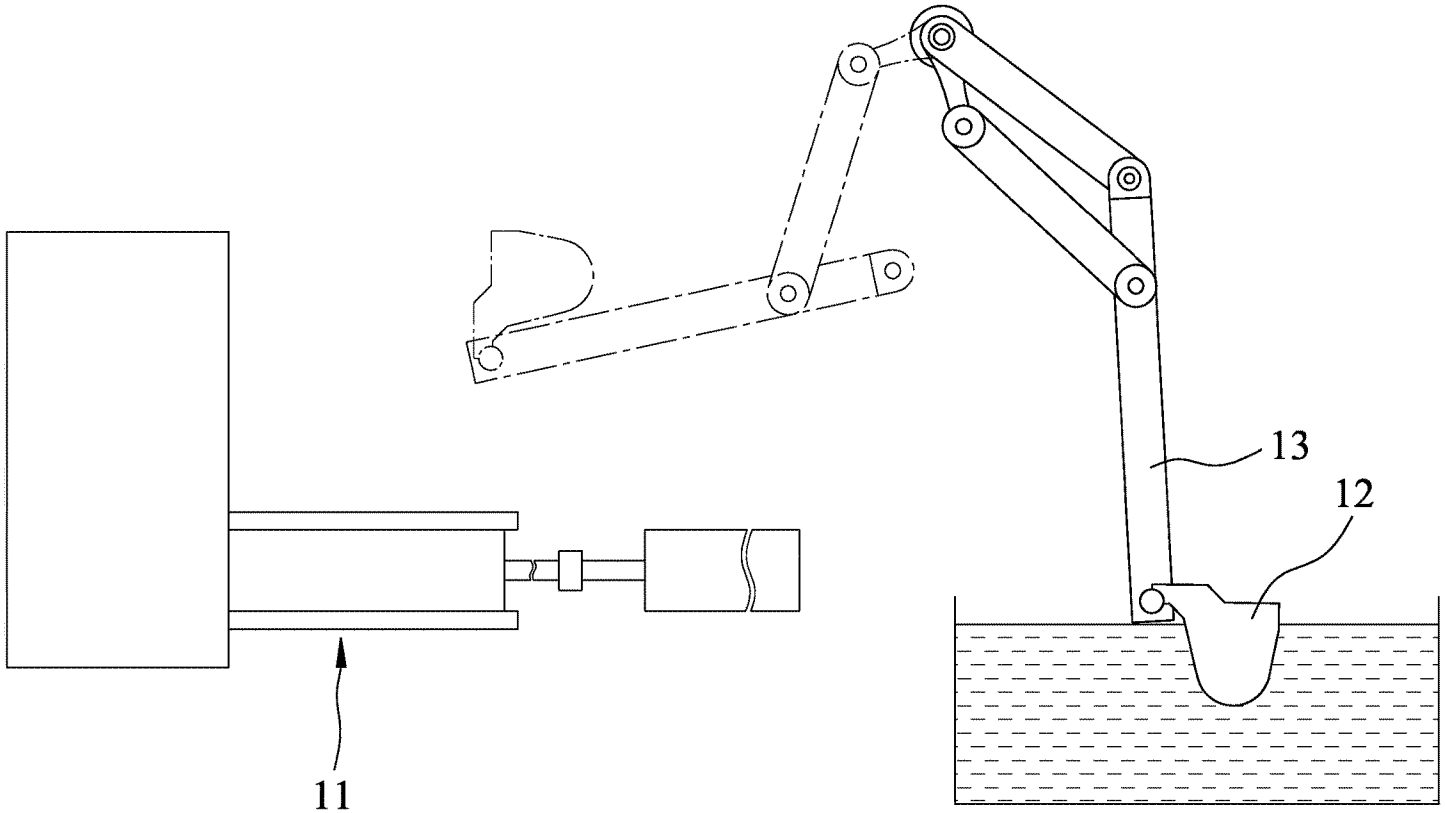
FIG.1 PRIOR ART
FIG. 1 is a schematic diagram illustrating a molten metal feed apparatus disclosed in U.S. Pat. No. 7,021,361.
Figure 2:
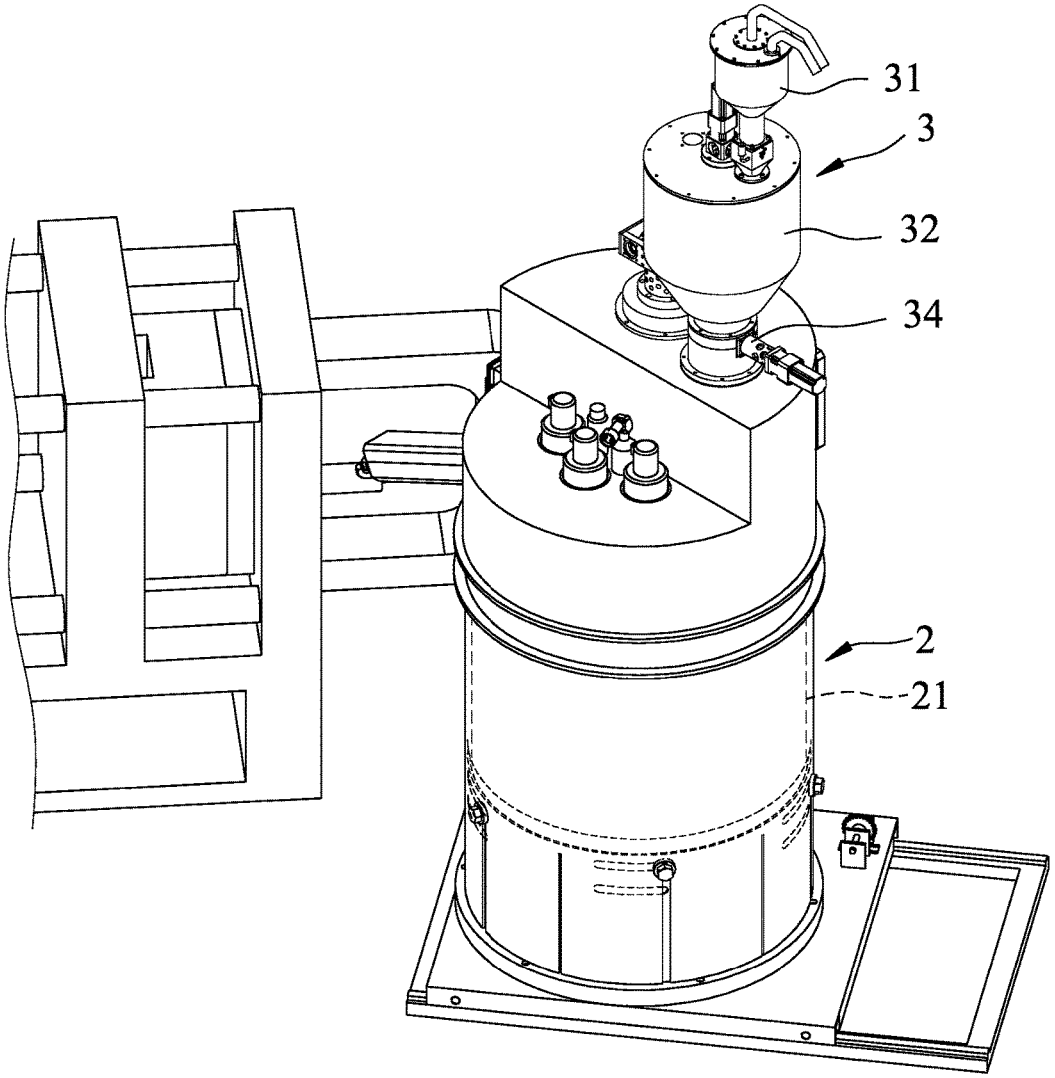
FIG.2 PRIOR ART
FIG. 2 is a perspective view illustrating an aluminum-based material melting apparatus disclosed in U.S. Patent Application Publication No. 2014/0054832.
Figure 3:
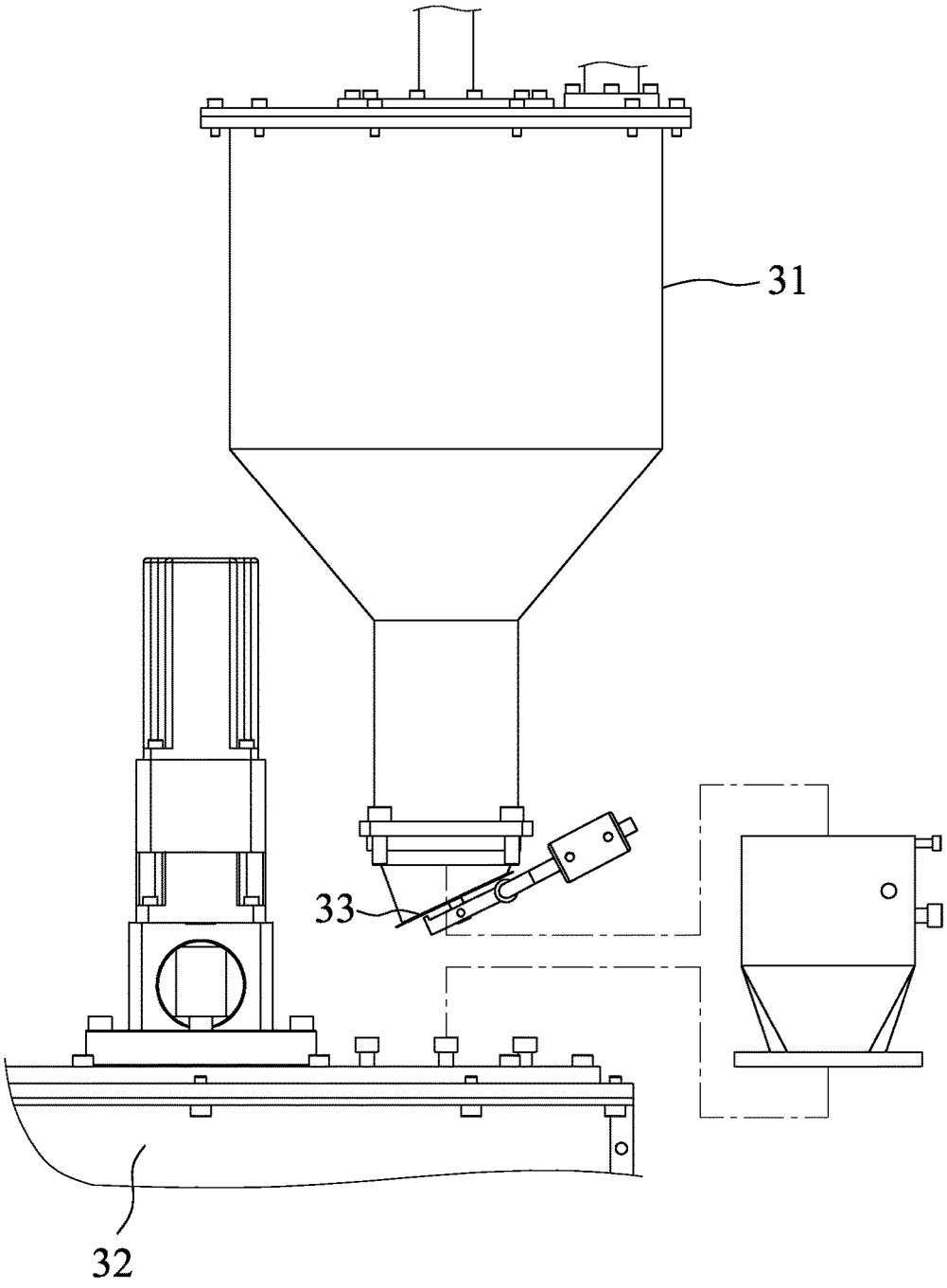
FIG.3 PRIOR ART
FIG. 3 is a partly exploded side view to illustrate a feed hopper and a valve mechanism of the aluminum-based material melting apparatus.
Figure 4:
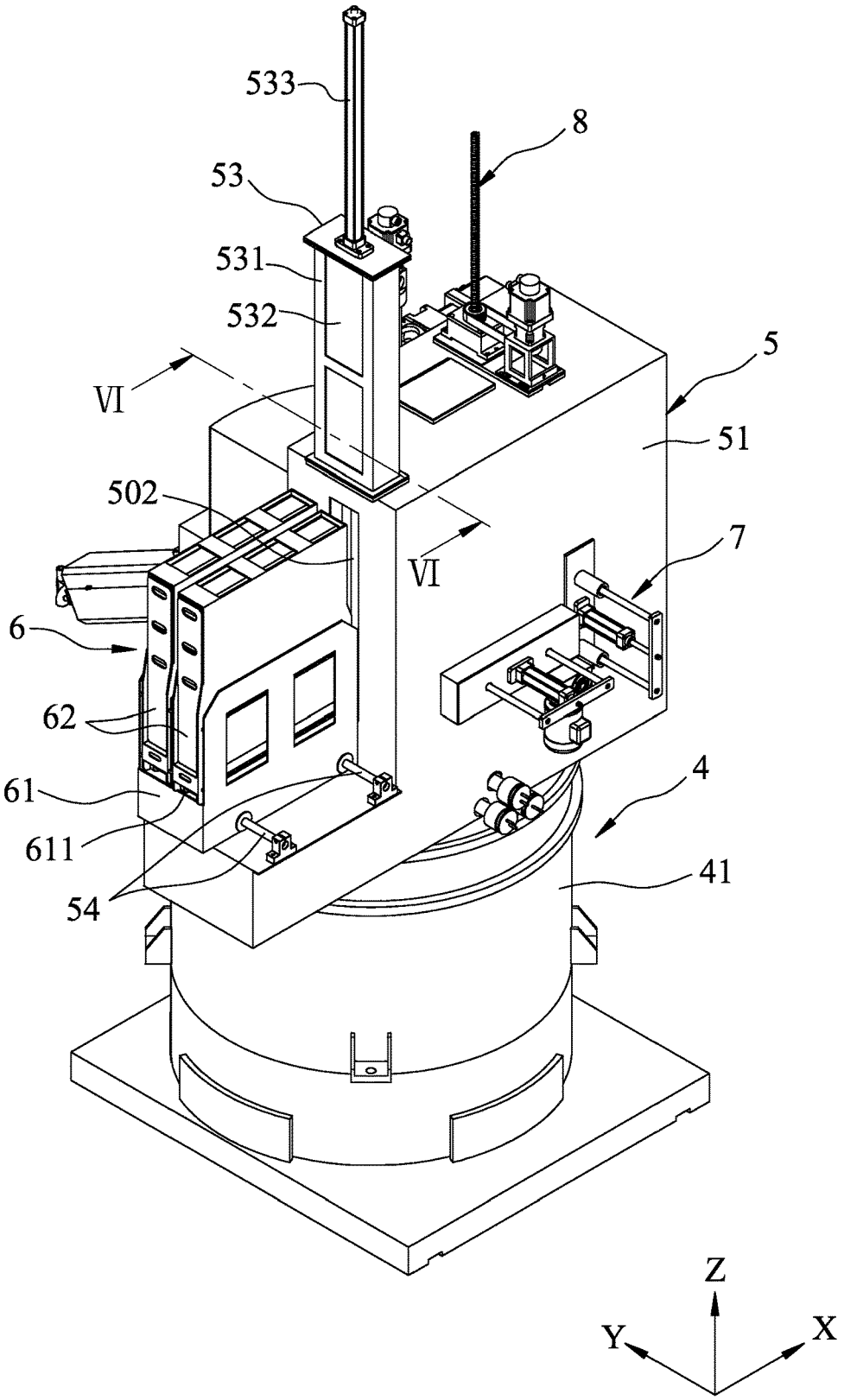
FIG. 4 is an assembled perspective view of the embodiment of an apparatus for feeding raw material bars to a melting furnace according to the disclosure.
Figure 5:
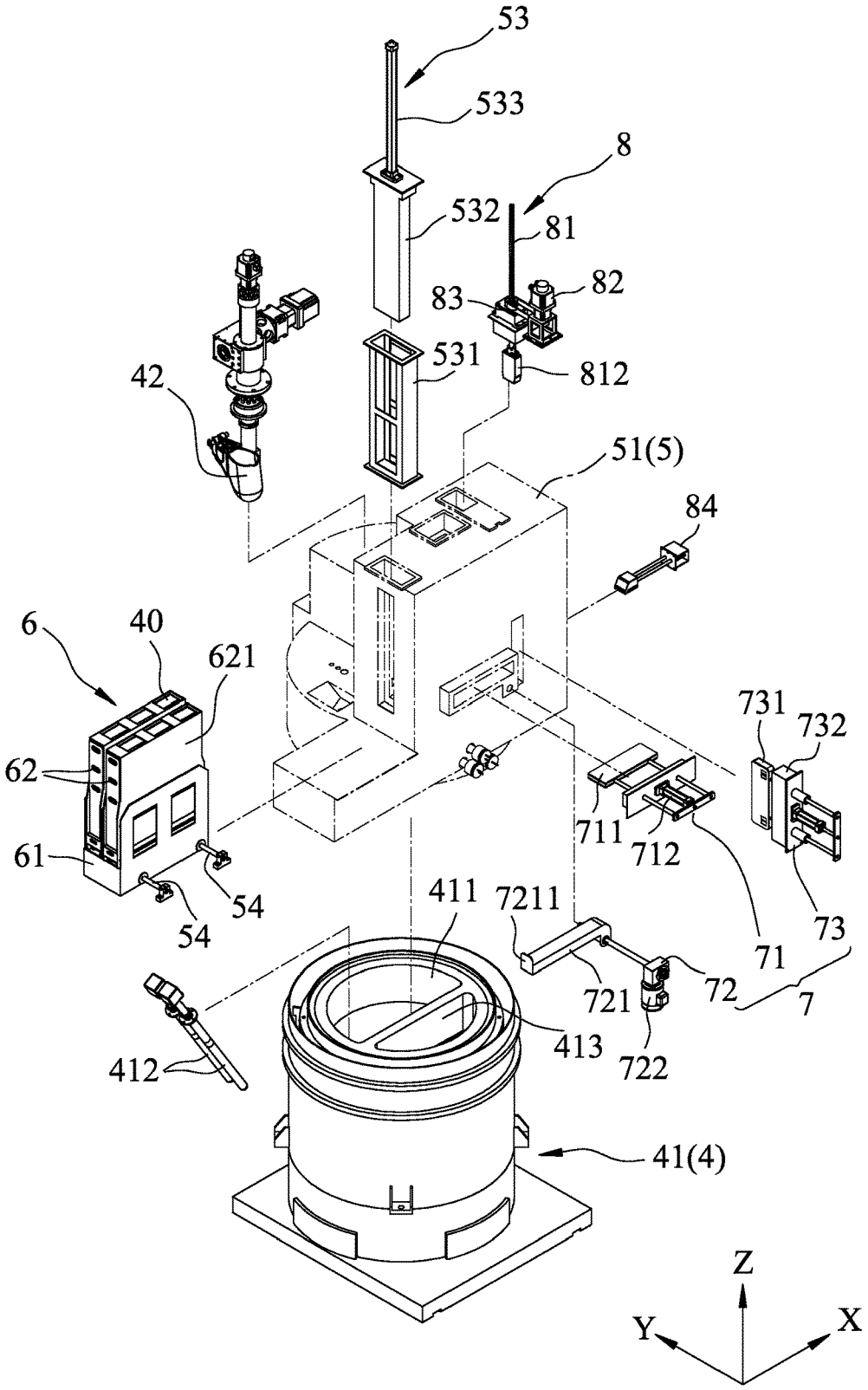
FIG. 5 is an exploded perspective view of the embodiment.
Figure 6:
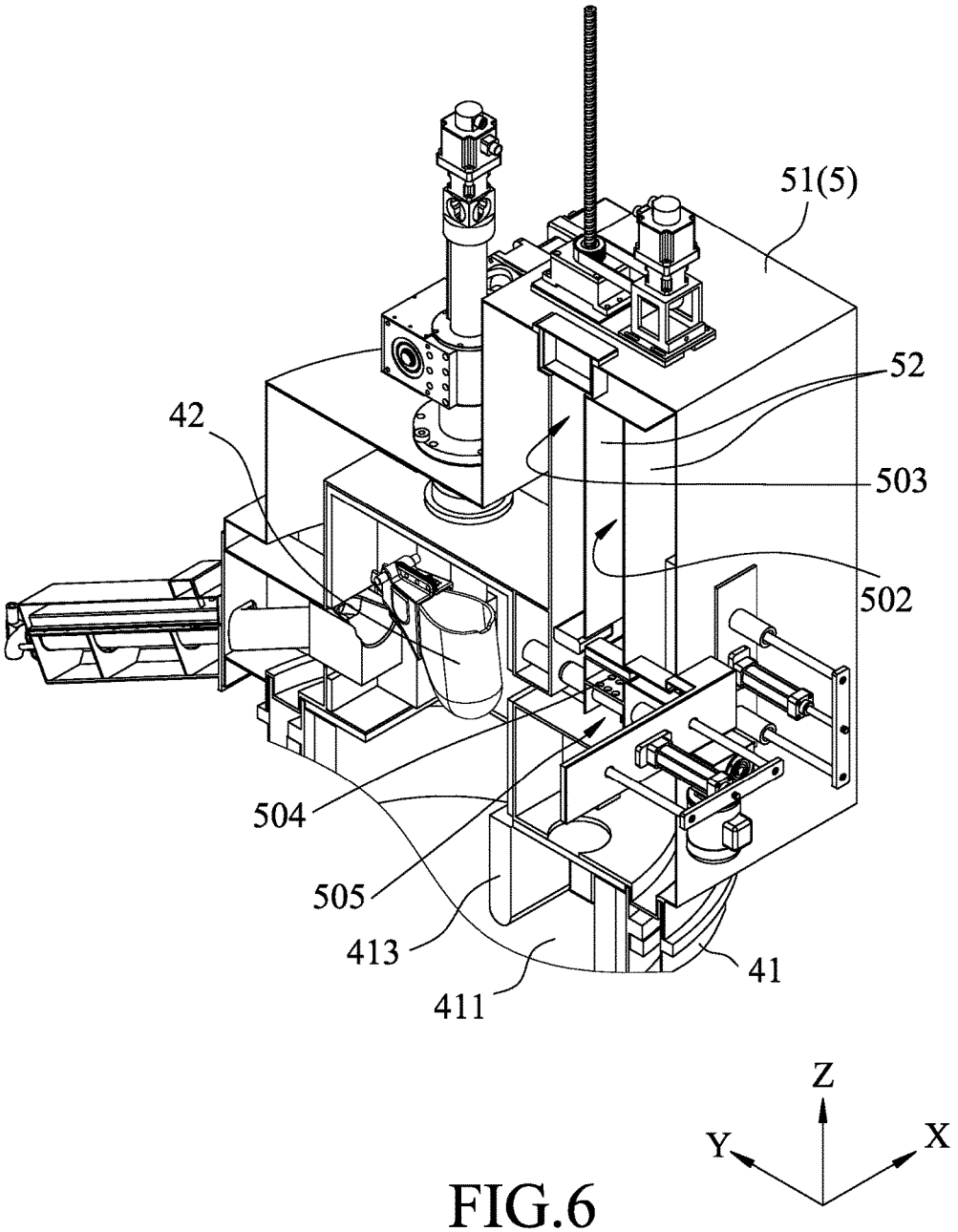
FIG. 6 is a perspective partly cutaway view of the embodiment, taken along line VI-VI in FIG. 4.

Referring to FIGS. 4 to 6, the embodiment of an apparatus according to the disclosure is adapted for feeding raw material bars 40 to a melting furnace 4. The melting furnace 4 includes a heating device 41 and a ladle device 42. The heating device 41 is for heating molten metal material and includes a furnace body 411 for containing the molten metal material, heating bars 412, and a partition plate 413 disposed in the furnace body 411. The raw material bars 40 are made of aluminum alloy in this embodiment, but may be made of other metal materials such as magnesium alloy. Since the feature of the disclosure does not reside in the specific configuration of the melting furnace 4, which may be readily appreciated by those skilled in the art, further details of the same will not be provided herein for the sake of brevity.

The apparatus of this embodiment includes an enclosure body 5, a carriage 6, a transferring unit 7, and a feeding unit 8.

To facilitate description, Z-direction is defined as the direction in which the height of the enclosure body 5 extends, and X-direction and Y-direction are mutually orthogonal directions that are also orthogonal to the Z-direction.

The enclosure body 5 is disposed above the heating device 41 and includes a housing 51, a plurality of partition plates 52 disposed in the housing 51, a gate mechanism 53, and a pair of parallel guide shafts 54 that are disposed on the housing 51, that extend horizontally in the Y-direction and that are spaced apart from each other in the X-direction.

The partition plates 52 partition an interior of the housing 51 into a vertically extending feed passage 501 (see FIG. 18) that is to be disposed above an open top side of the furnace body 411 and that is for spatial communication with the furnace body 411, an access passage 502 that is for spatial communication with an exterior of the housing 51, a bar guiding space 503 that is in spatial communication with the feed passage 501 and the access passage 502, and a vent passage 505 that is for spatial communication with the furnace body 411. At least one of the partition plates 52 is formed with vent holes 504 in spatial communication with the access passage 502 and the vent passage 505. In this embodiment, a bar delivery hole 506 (see FIG. 18) is formed in one of the partition plates 52 at a junction of the bar guiding space 503 and the feed passage 501 and is configured to permit passage of a vertically oriented raw material bar 40 from the bar guiding space 503 to the feed passage 501.

The gate mechanism 53 includes a support 531 disposed on the housing 51, a gate member 532 disposed movably at the support 531 and slidable on the support 531 along the Z-direction, and a pressure cylinder 533 for driving opening and closing movement of the gate member 532. In this embodiment, the pressure cylinder 533 is a pneumatic cylinder, but the present disclosure is not limited in this respect.

Figure 7:
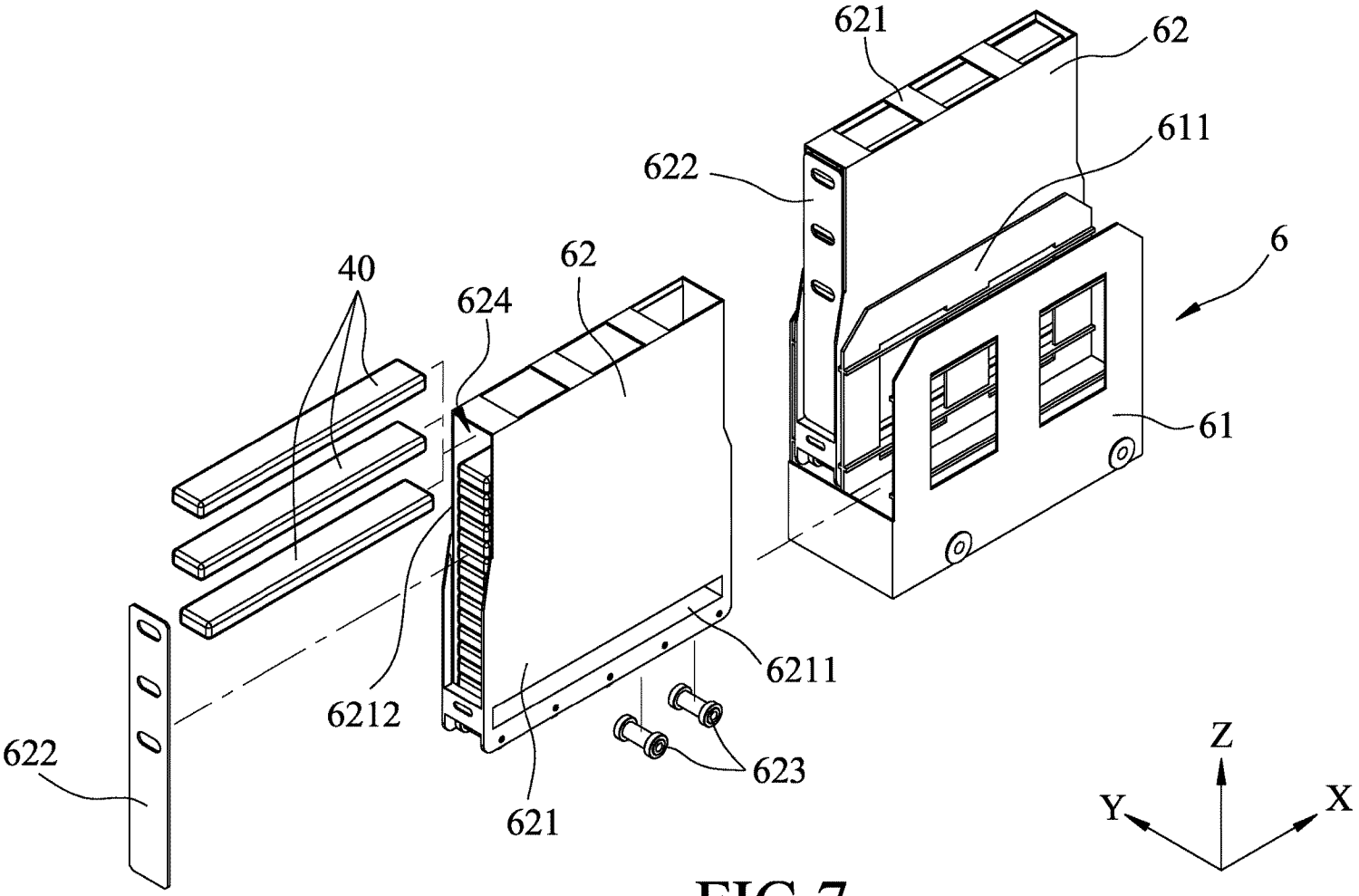
FIG. 7 is a partly exploded perspective view of a carriage of the embodiment.

Referring to FIGS. 4 and 7, the carriage 6 of this embodiment includes a movable base 61 and two raw material bar holders 62. The movable base 61 is slidably disposed on the guide shafts 54, which are disposed outside and adjacent to the access passage 502. The movable base 61 has two slide grooves 611, each of which has one of the raw material bar holders 62 movably disposed thereat. The movable base 61 is movable on the guide shafts 54 along the Y-direction to align a selected one of the slide grooves 611 with the access passage 502 and permit movement of one of the raw material bar holders 62 along the X-direction into and out of the access passage 502. The movable base 61 may be manually moved on the guide shafts 54 but the present disclosure is not limited in this respect. In this embodiment, only one of the raw material bar holders 62 may enter the access passage 502 at any time, and the other raw material bar holder 62 is in a standby state outside the enclosure body 5. Moreover, the raw material bar holders 62 may be manually moved into and out of the access passage 502 but the present disclosure is not limited in this respect.

Each raw material bar holder 62 includes a casing body 621, a barrier plate 622, and a plurality of rollers 623 mounted rotatably to the casing body 621 for moving the raw material bar holder 62 into and out of the access passage 502. The rollers 623 extend in the Y-direction and are spaced apart from each other in the X-direction. The casing body 621 has an opposing pair of casing walls, and a lower part of the casing walls is formed with a pair of bar passage slots 6211 that extend horizontally in the X-direction and that are registered with each other in the Y-direction. The casing body 621 has one side formed with a bar entrance opening 6212. The barrier plate 622 is connected removably to the casing body 621 for covering and uncovering the bar entrance opening 6212, and cooperates with the casing body 621 to confine a receiving space 624 for receiving the raw material bars 40. Each raw material bar holder 62 is configured to hold the raw material bars 40 in a manner that the raw material bars 40 extend horizontally and are disposed in a stack along the Z-direction inside the receiving space 624. The raw material bars 40 may be manually supplied to the receiving space 624 but the present disclosure is not limited in this respect. The bar passage slots 6211 permit removal of a lowermost one of the raw material bars 40 in the stack from the raw material bar holder 62 by the transferring unit 7.

Referring to FIG. 5, the transferring unit 7 is disposed at the enclosure body 5 and includes a bar moving sub-unit 71, an orientation converting sub-unit 72, and a bar delivering sub-unit 73. In this embodiment, the bar moving sub-unit 71 includes a bar moving member 711 and a first drive member 712 coupled to the bar moving member 711 and operable to drive back and forth movement of the bar moving member 711 in the Y-direction relative to the raw material bar holder 62 inside the access passage 502. The orientation converting sub-unit 72 includes a rotatable bar guiding member 721 and a second drive member 722 coupled to and configured to drive bidirectional rotation of the bar guiding member 721 about the Y-direction. The bar delivering sub-unit 73 includes a bar advancing member 731 and a third drive member 732 coupled to the bar advancing member 731 and operable to drive back and forth movement of the bar advancing member 731 in the Y-direction relative to the feed passage 501. In this embodiment, the bar guiding member 721 has one end distal from the second drive member 722 and provided with a stop portion 7211. While the first drive member 712 and the third drive member 732 are exemplified using pneumatic cylinders in this embodiment, and the second drive member 722 is exemplified using a motor in this embodiment, the present disclosure is not limited in this respect.

Figure 8:
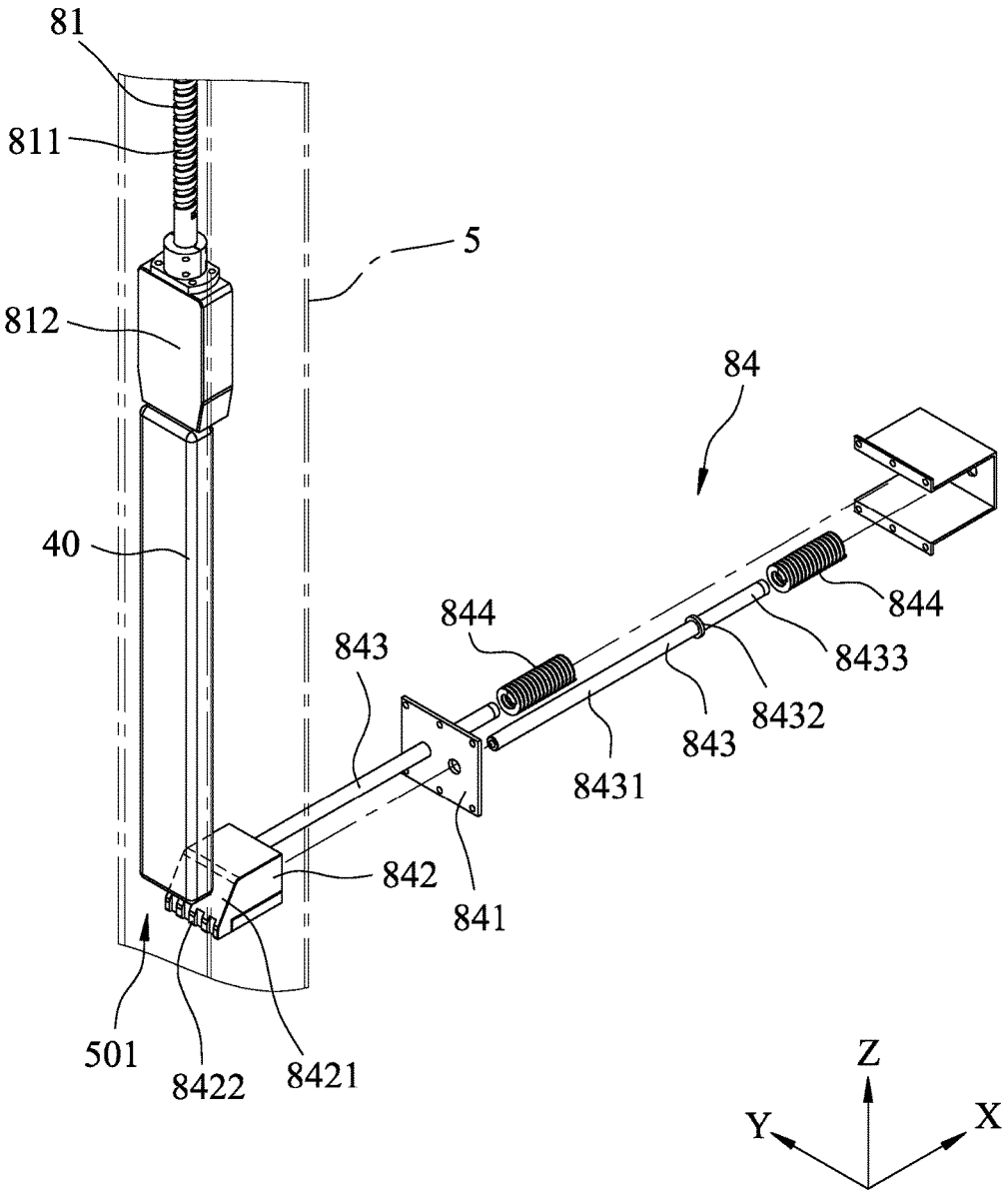
FIG. 8 is a partly exploded perspective view of a feeding unit of the embodiment.

Referring to FIG. 8, the feeding unit 8 is disposed at the enclosure body 5 and includes a push mechanism 81 that extends vertically into an upper part of the feed passage 501, and a material retarder 84 that extends into a lower part of the feed passage 501.

The push mechanism 81 includes a vertically extending screw rod segment 811 and a push block segment 812 coupled to a bottom end of the screw rod segment 811 and disposed in the feed passage 501. As shown in FIG. 5, the push mechanism 81 further includes an actuator 82 and a transmission belt 83. In this embodiment, the actuator 82 is a servo motor, but the present disclosure is not limited in this respect. The transmission belt 83 is trained between the screw rod segment 811 and the actuator 82. The actuator 82 is configured to drive rotation of the screw rod segment 811 via the transmission belt 83 for moving the push block segment 812 up and down in the Z-direction, thereby controlling downward moving speed of the raw material bar 40 in the feed passage 501.

Referring to FIG. 8, the material retarder 84 includes a limit cage 841 disposed at the enclosure body 5, a blocker 842, a pair of fixing shafts 843, and a pair of biasing components 844.

In this embodiment, the blocker 842 has an inclined face 8421 and a resisting part 8422 at a lower edge of the inclined face 8421. The inclined face 8421 and the resisting part 8422 are disposed in the feed passage 501 for contacting the raw material bar 40 in the feed passage 501. In this embodiment, each fixing shaft 843 extends in the X-direction, and has a front end connected to one side of the blocker 842 opposite to the inclined face 8421, a slide section 8431 extending slidably into the limit cage 841 and slidable along the X-direction, a limit section 8432 to abut against the limit cage 841, and a sleeve section 8433 disposed rearwardly of the limit section 8432 for sleeving of a respective one of the biasing components 844 and extending slidably through the limit cage 841. In this embodiment, each biasing component 844 is a compression spring that stores a restoring force when compressed, and has opposite ends respectively abutting against the limit cage 841 and the limit section 8432 on the respective fixing shaft 843. The biasing components 844 bias the fixing shafts 843 for moving the blocker 842 to project into the feed passage 501.

The material retarder 84 is configured to retard downward movement of the raw material bar 40 out of the feed passage 501 and into the furnace body 411, and is designed to prevent free fall of the raw material bar 40 in the feed passage 501. When the raw material bar 40 in the feed passage 501 is pushed downward by the push mechanism 81, the raw material bar 40 applies a downward pushing force on the inclined face 8421 of the blocker 842. When the downward pushing force is sufficient to overcome the biasing force of the biasing components 844, the blocker 842 moves rearward in the X-direction and the raw material bar 40 moves downward in the Z-direction inside the feed passage 501. However, the blocker 842 continues to contact the raw material bar 40, and friction is generated as a result of contact between the raw material bar 40 and the resisting part 8422 of the blocker 842, thereby arresting free fall of the raw material bar 40 out of the feed passage 501 and into the furnace body 411.

How the raw material bars 40 are fed to the furnace body 411 using the apparatus of this disclosure will be described in greater detail in the succeeding paragraphs.

Referring to FIG. 7, during a pre-feeding operation, the raw material bars 40 are stacked in the Z-direction inside the casing body 621 of one of the raw material bar holders 62 via the bar entrance opening 6212. The barrier plate 622 is then used to cover the bar entrance opening 6212 for preventing the raw material bars 40 from falling out of the casing body 621.

Figure 9:
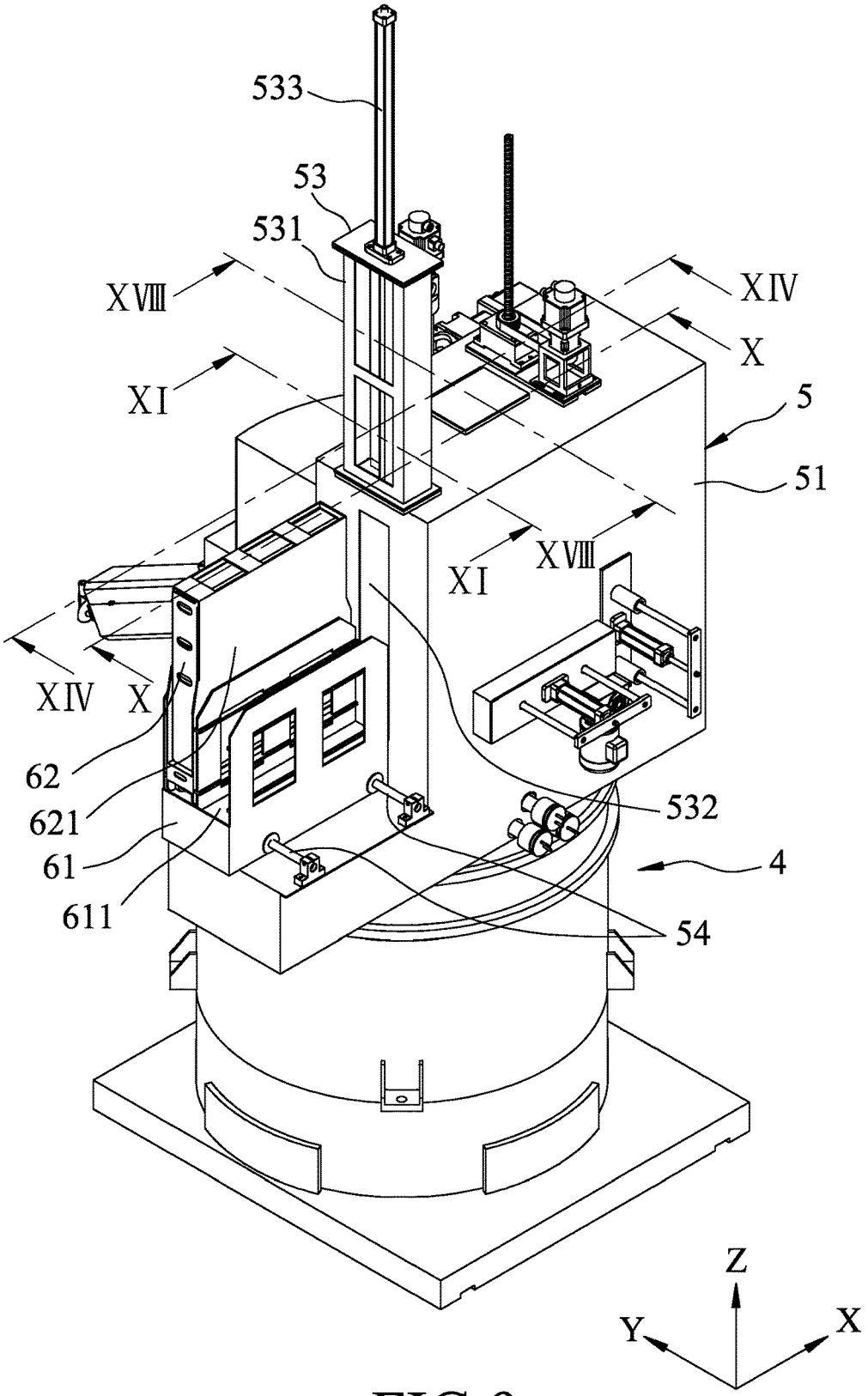
FIG. 9 is a perspective view illustrating a state where a raw material bar holder is disposed inside an enclosure body.
Figure 10:
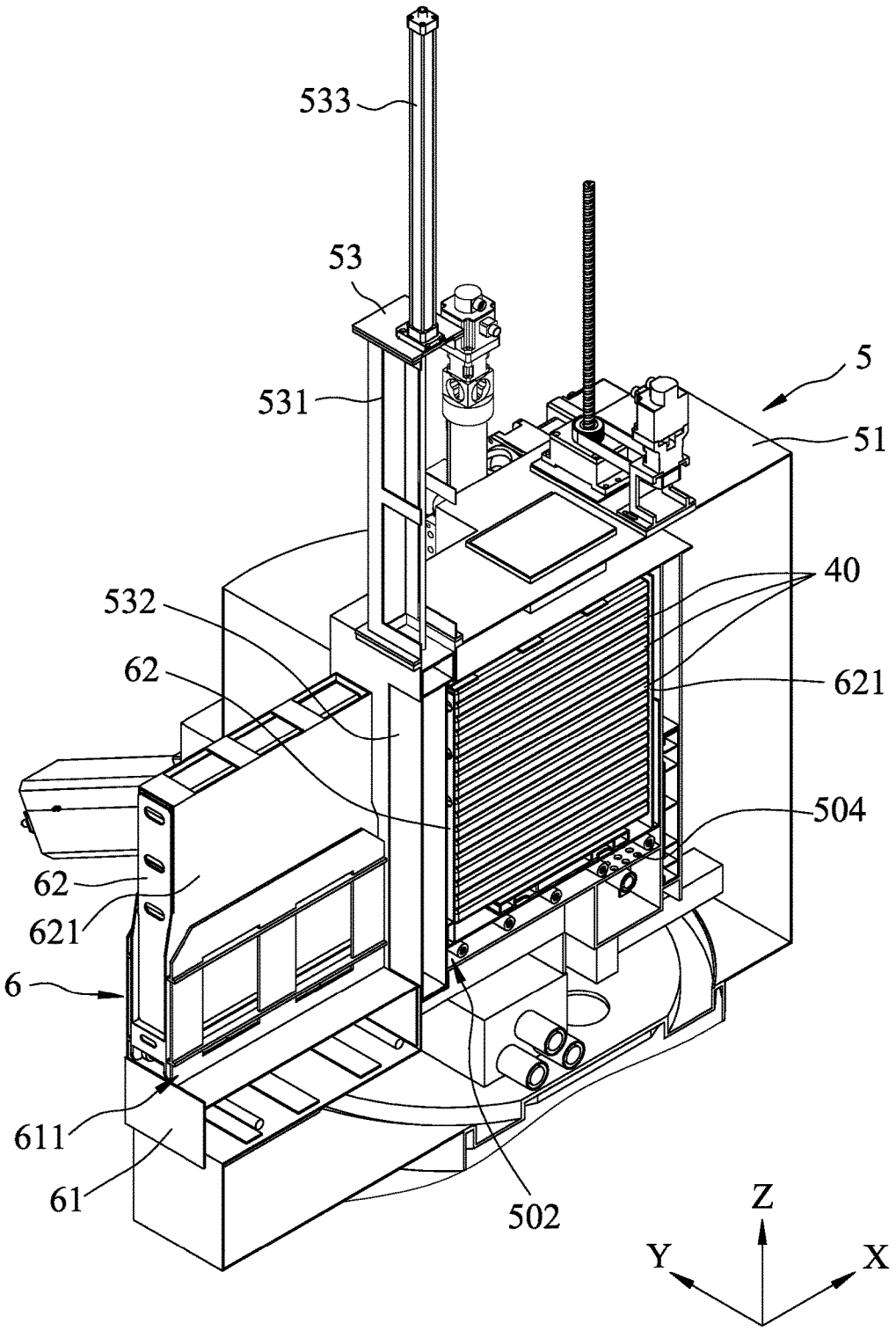
FIG. 10 is a perspective partly cutaway view of the embodiment, taken along line X-X in FIG. 9, to illustrate the raw material bar holder inside an access passage.

Referring to FIG. 4, the pressure cylinder 533 of the gate mechanism 53 is activated, such as with the use of a computerized control system (not shown), to move the gate member 532 upward in the Z-direction so that access to the access passage 502 is permitted. Referring to FIGS. 9 and 10, the raw material bar holder 62 filled with the raw material bars 40 is then moved along the corresponding slide groove 611 of the movable base 61 in the X-direction to enter the access passage 502. Thereafter, the pressure cylinder 533 is activated, such as via the computerized control system, to move the gate member 532 downward in the Z-direction, thereby closing the access passage 502 to result in a sealed state of the enclosure body 5 and to prevent entry of contaminants and/or ambient cold air. Accordingly, stability of an internal environment of the enclosure body 5 may be ensured.

Figure 18:
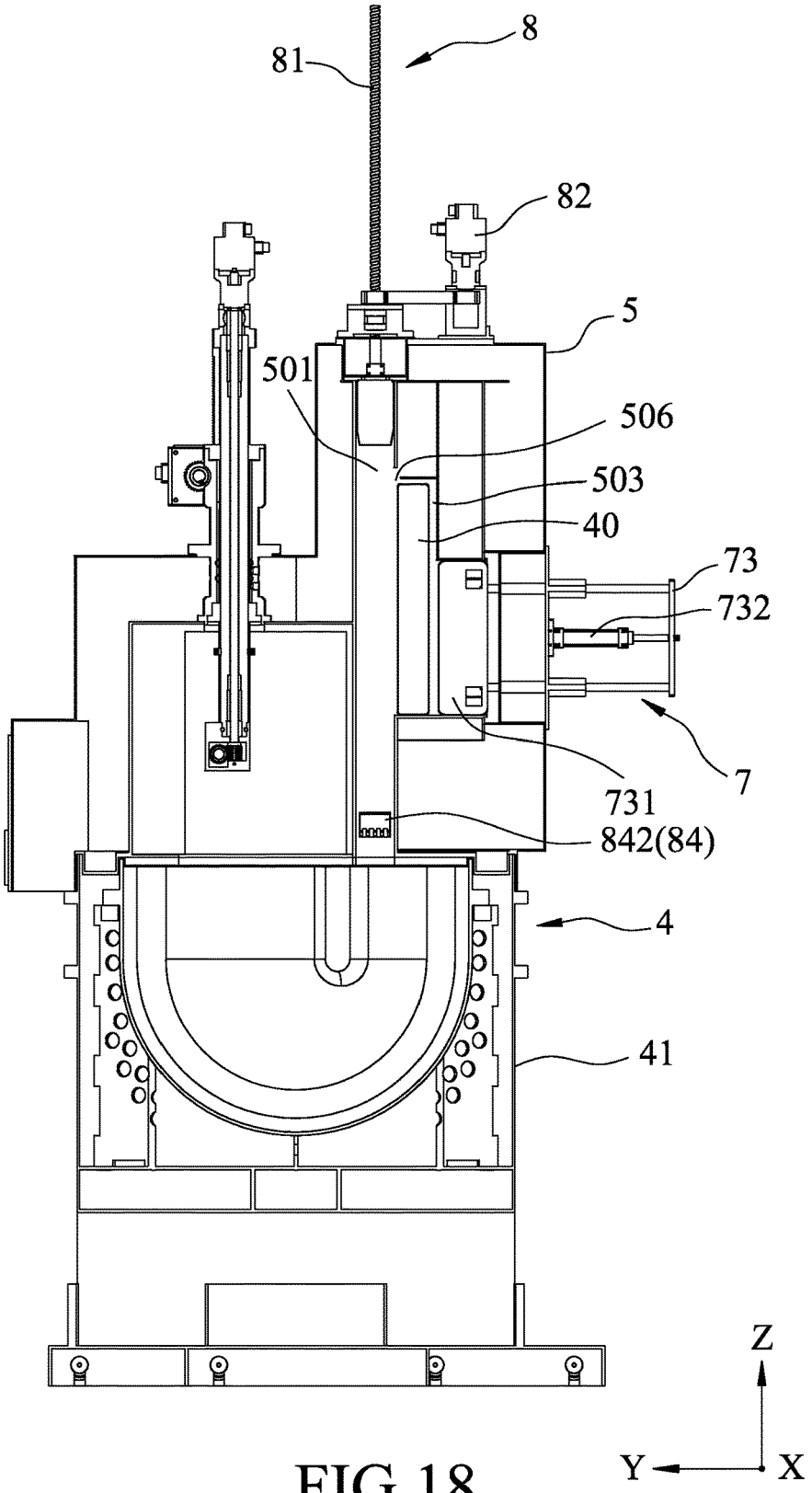
FIG. 18 is a schematic view of the embodiment, viewed from line XVIII-XVIII in FIG. 9, to illustrate position relationship between the bar delivering sub-unit and the feeding unit.

Referring to FIGS. 5 and 6, when the apparatus of this embodiment is in use, the heating device 41 of the melting furnace 4 is also enabled for proceeding with a heating operation. The heating bars 412 are activated to heat metal raw material in the furnace body 411. The furnace body 411 normally contains an amount of molten liquid for scooping by the ladle device 42. The partition plate 413 is disposed adjacent to the feed passage 501, and is used to separate a to-be-melted raw material bar 40 from the ladle device 42. High temperature gas is produced when the furnace body 411 is in a heated state, and flows into the access passage 502 via the vent passage 505 and the vent holes 504, thereby preheating the raw material bars 40 stored in the raw material bar holder 62 inside the access passage 502. Referring to FIG. 18, the high temperature gas also flows into the access passage 502 via the feed passage 501, the bar delivery hole 506 and the bar guiding space 503, thereby preheating the raw material bar 40 in the feed passage 501 or the bar guiding space 503.

Figure 11:
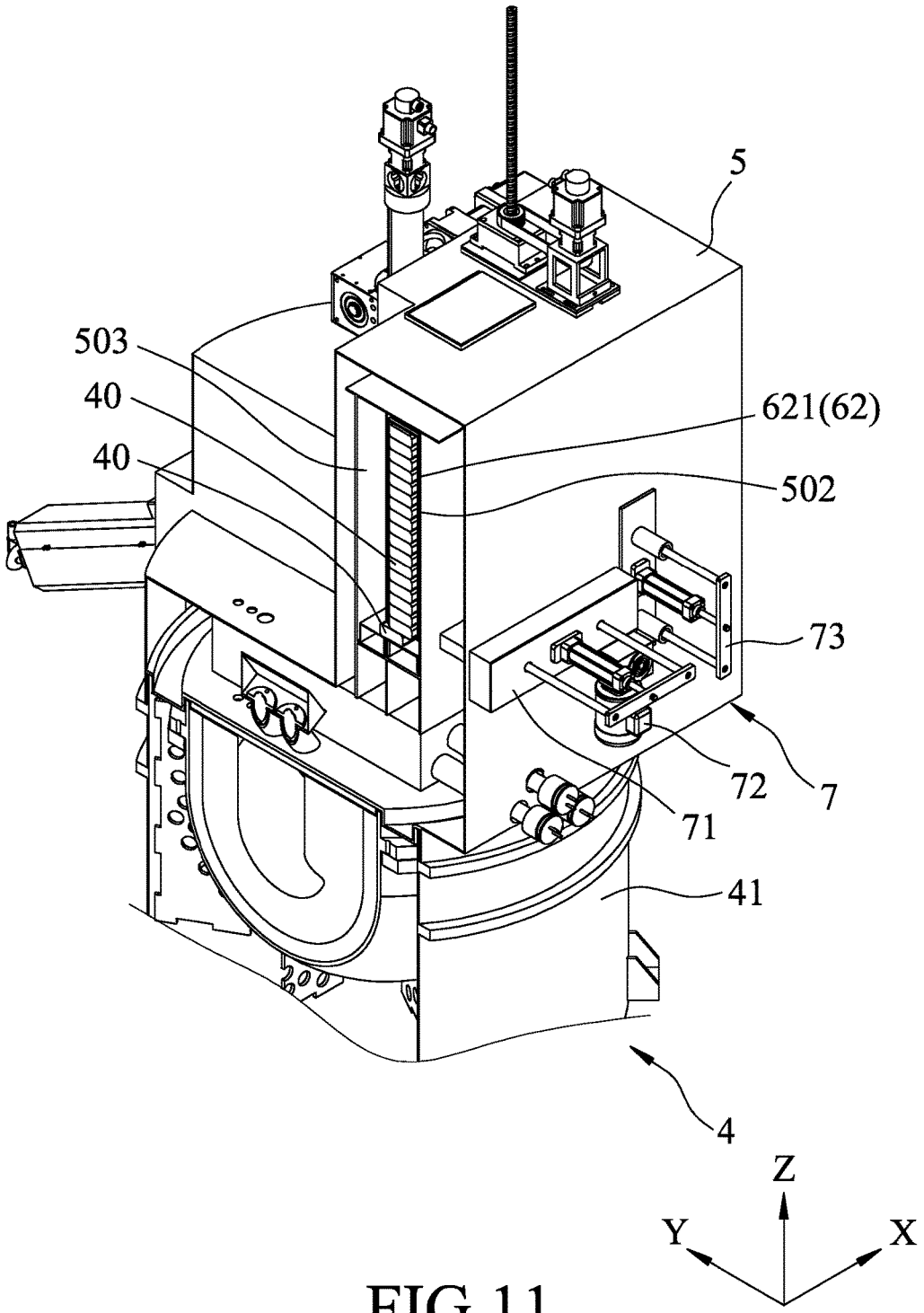
FIG. 11 is a perspective partly cutaway view of the embodiment, taken along line XI-XI in FIG. 9, to illustrate operation of a bar moving sub-unit.
Figure 12:
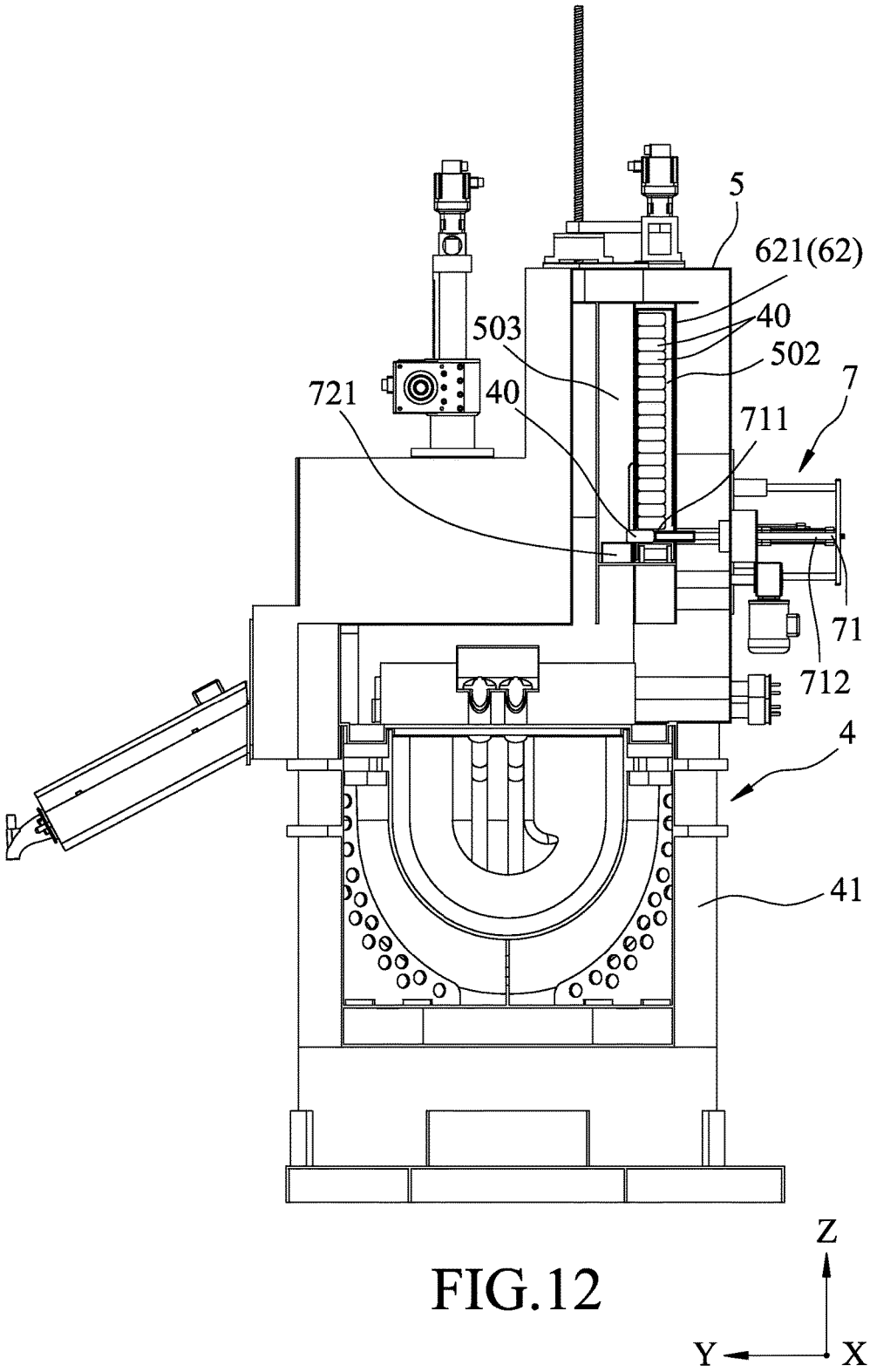
FIG. 12 is a schematic view of the embodiment, illustrating a raw material bar being moved by the bar moving sub-unit.
Figure 13:
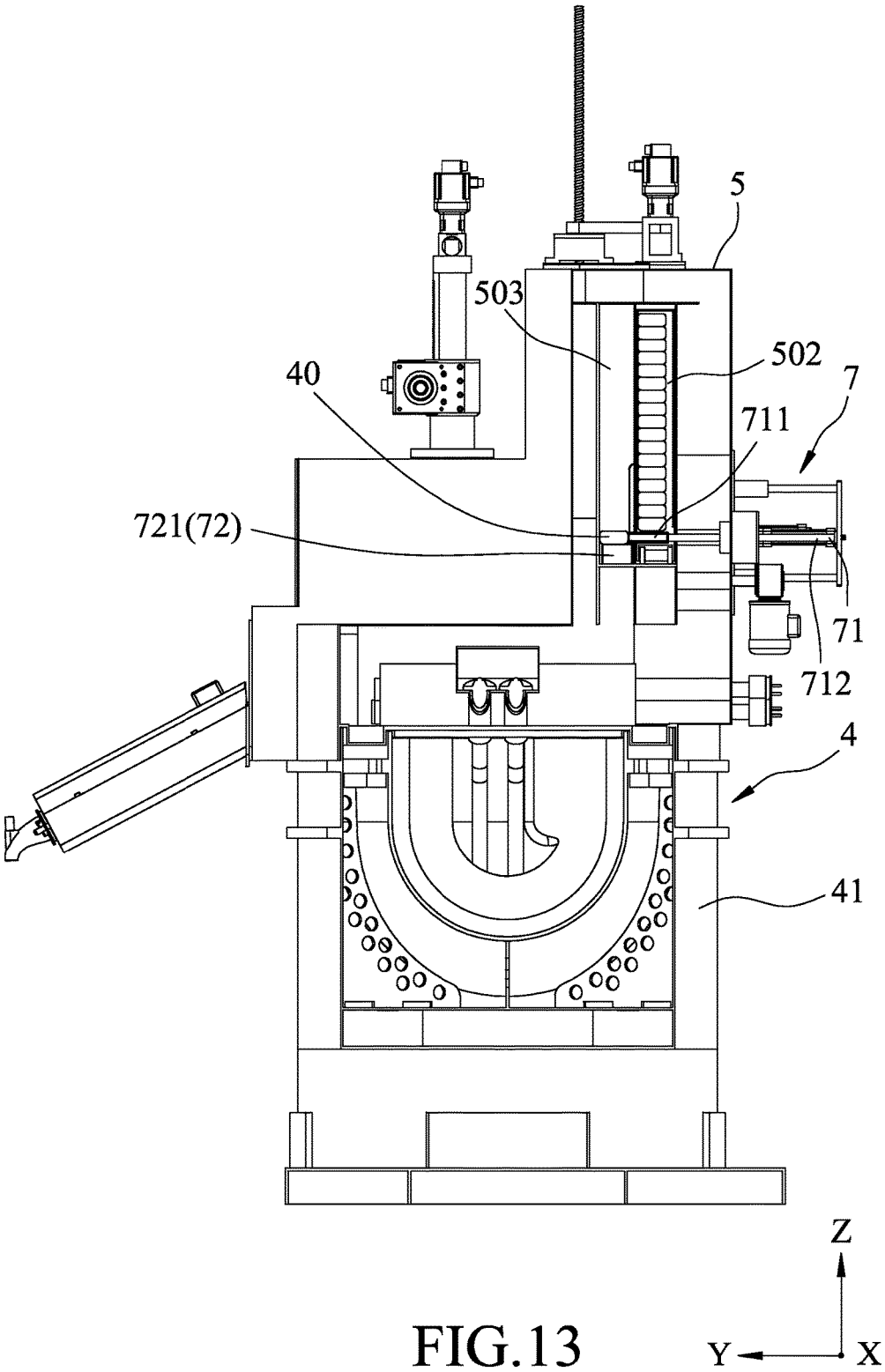
FIG. 13 is a view similar to FIG. 12, illustrating the raw material bar moved by the bar moving sub-unit to an orientation converting sub-unit.
Figure 14:
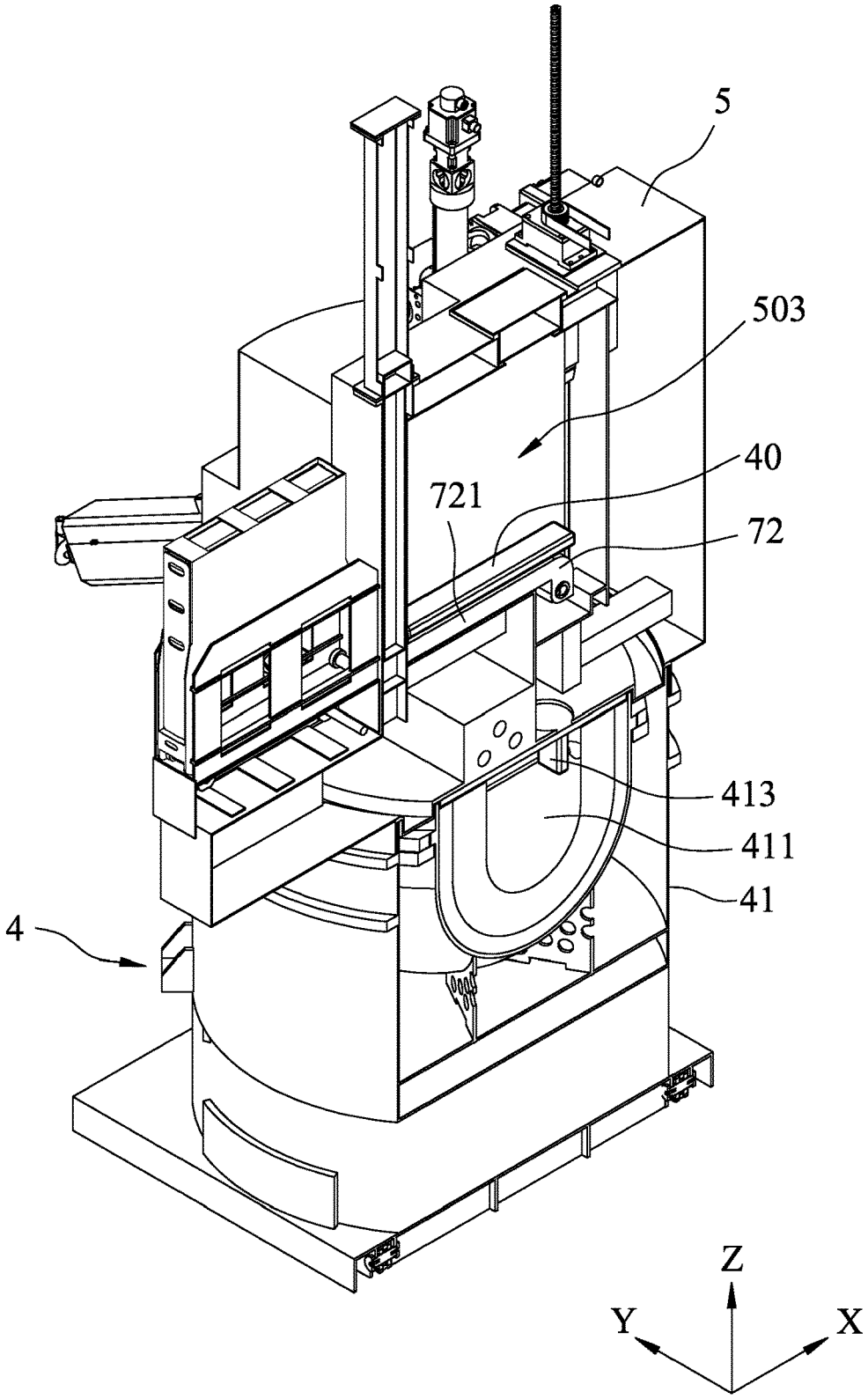
FIG. 14 is a perspective partly cutaway view of the embodiment, taken along line XIV-XIV in FIG. 9, to illustrate the raw material bar received by the orientation converting sub-unit.
Figure 15:
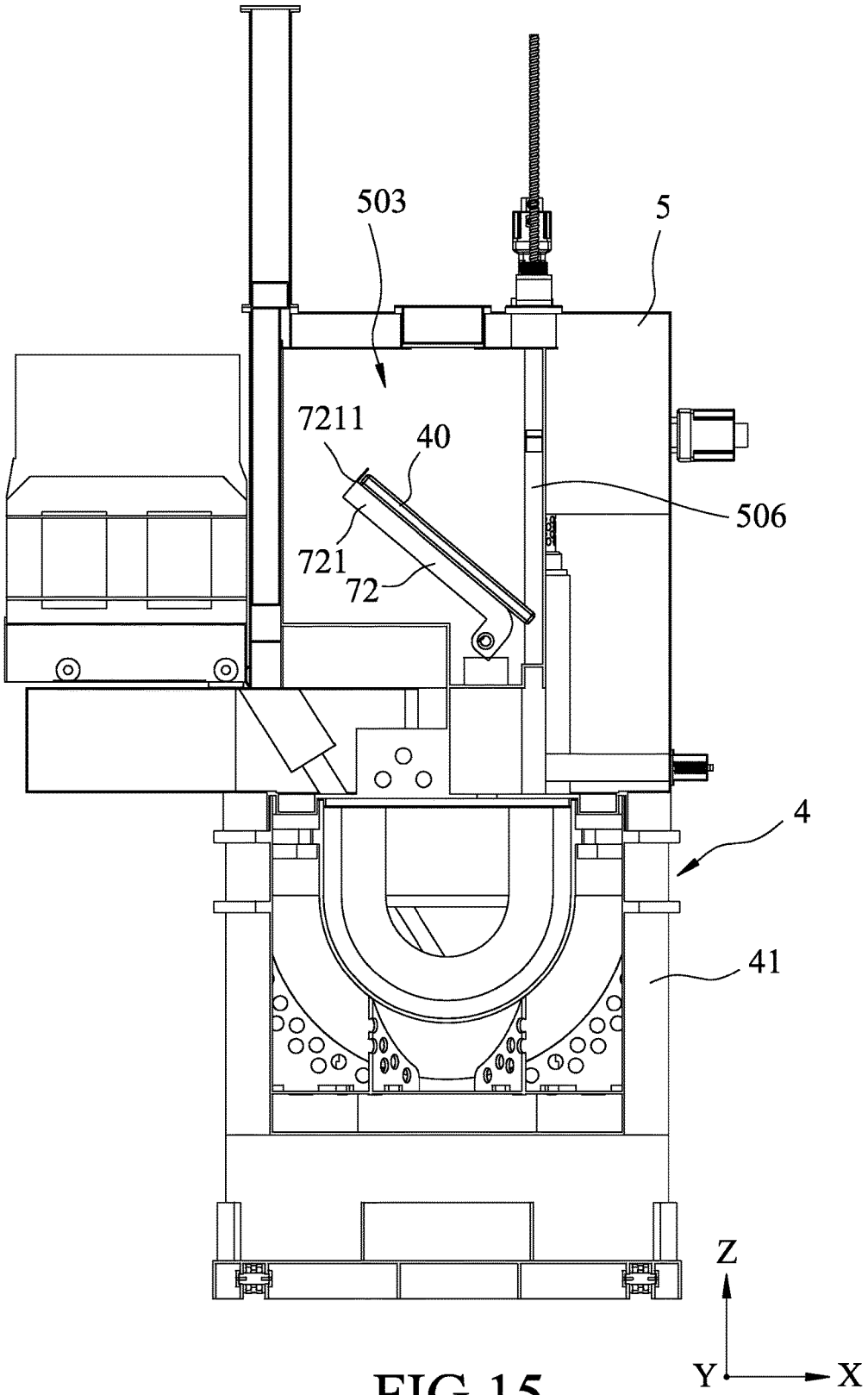
FIG. 15 is a schematic view of the embodiment, illustrating the raw material bar being converted from a horizontal orientation by the orientation converting sub-unit.
Figure 16:
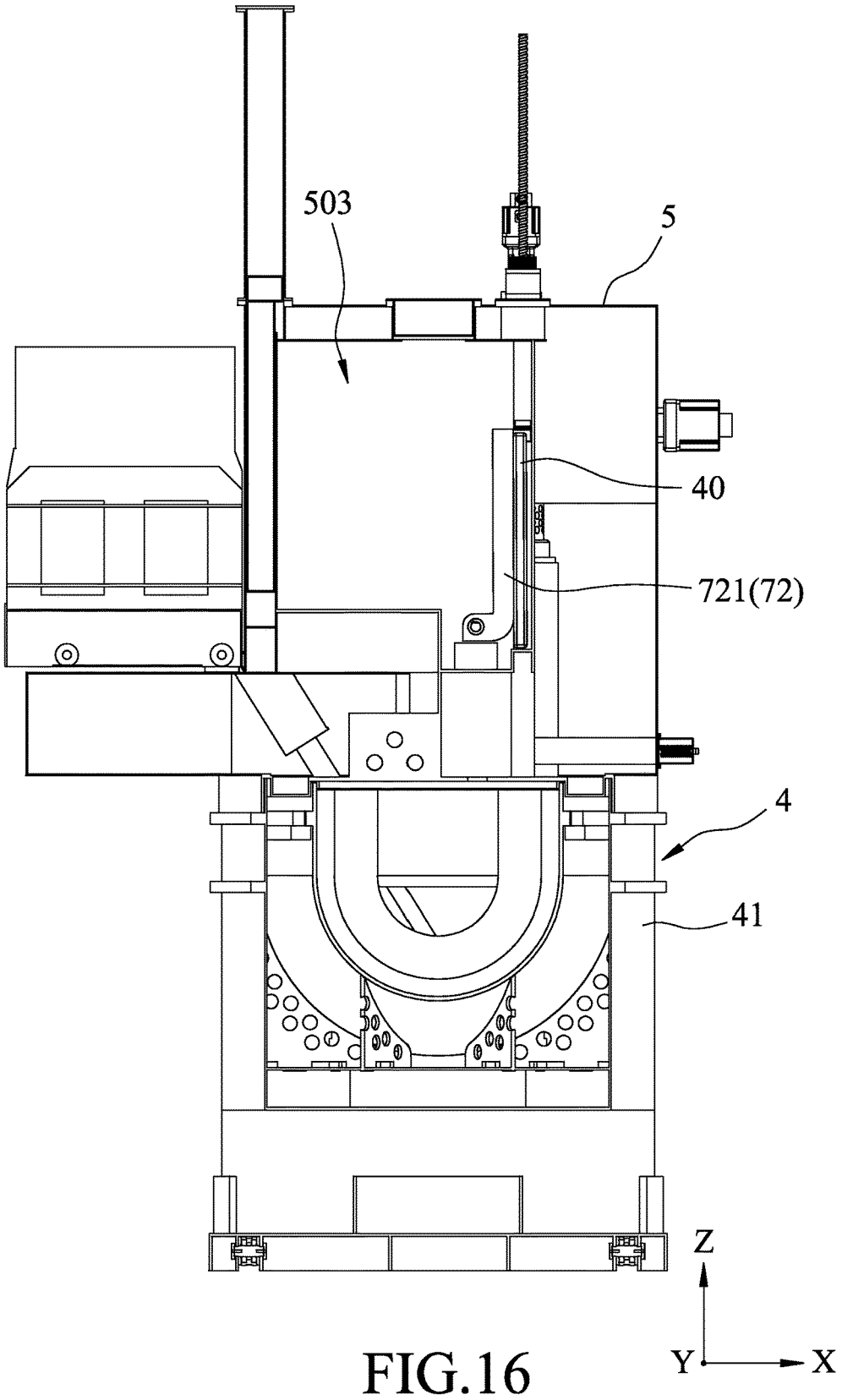
FIG. 16 is a view similar to FIG. 15, illustrating the raw material bar after being converted to a vertical orientation by the orientation converting sub-unit.
Figure 17:
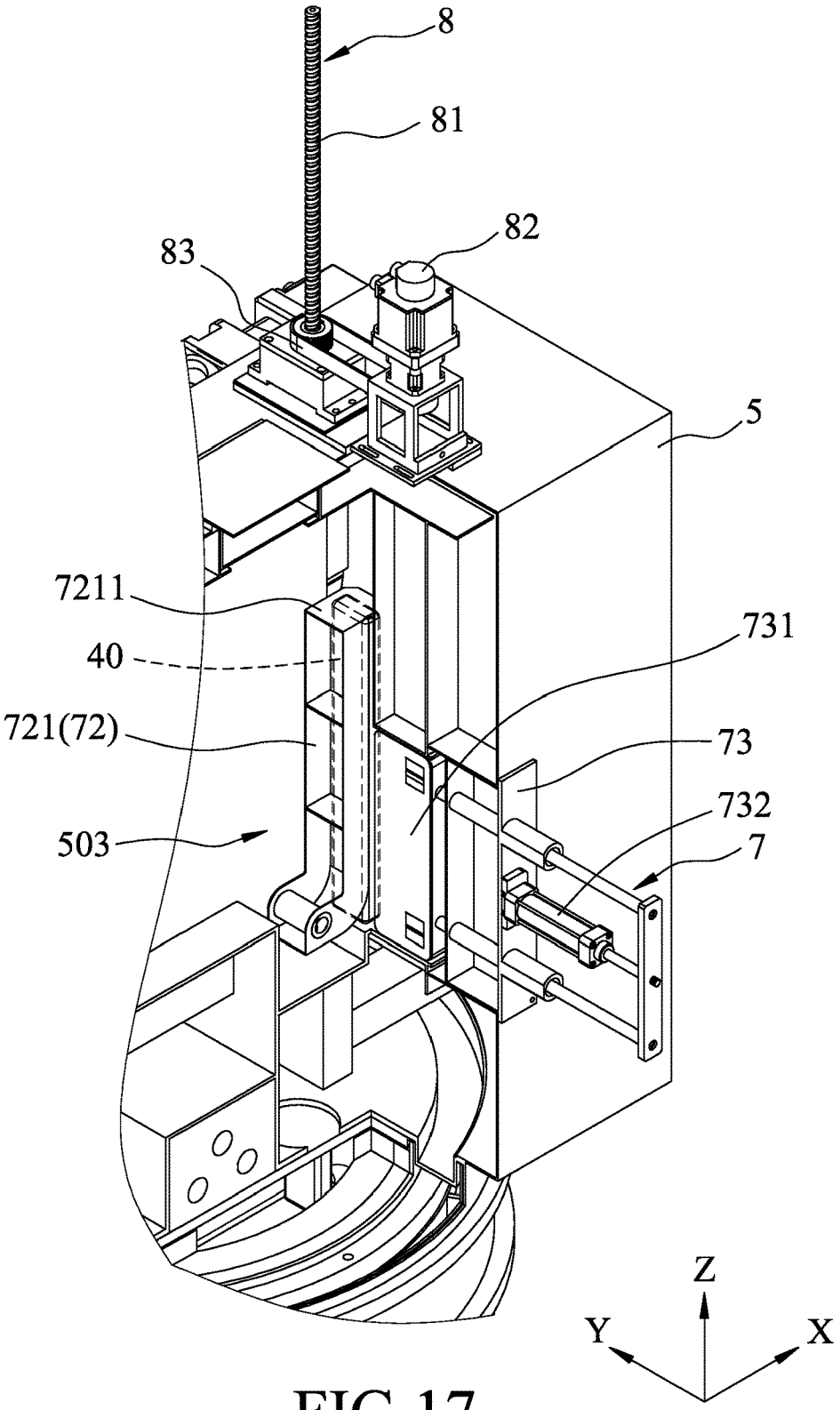
FIG. 17 is a fragmentary perspective view of the embodiment, illustrating position relationship between the orientation converting sub-unit and a bar delivering sub-unit.
Figure 19:
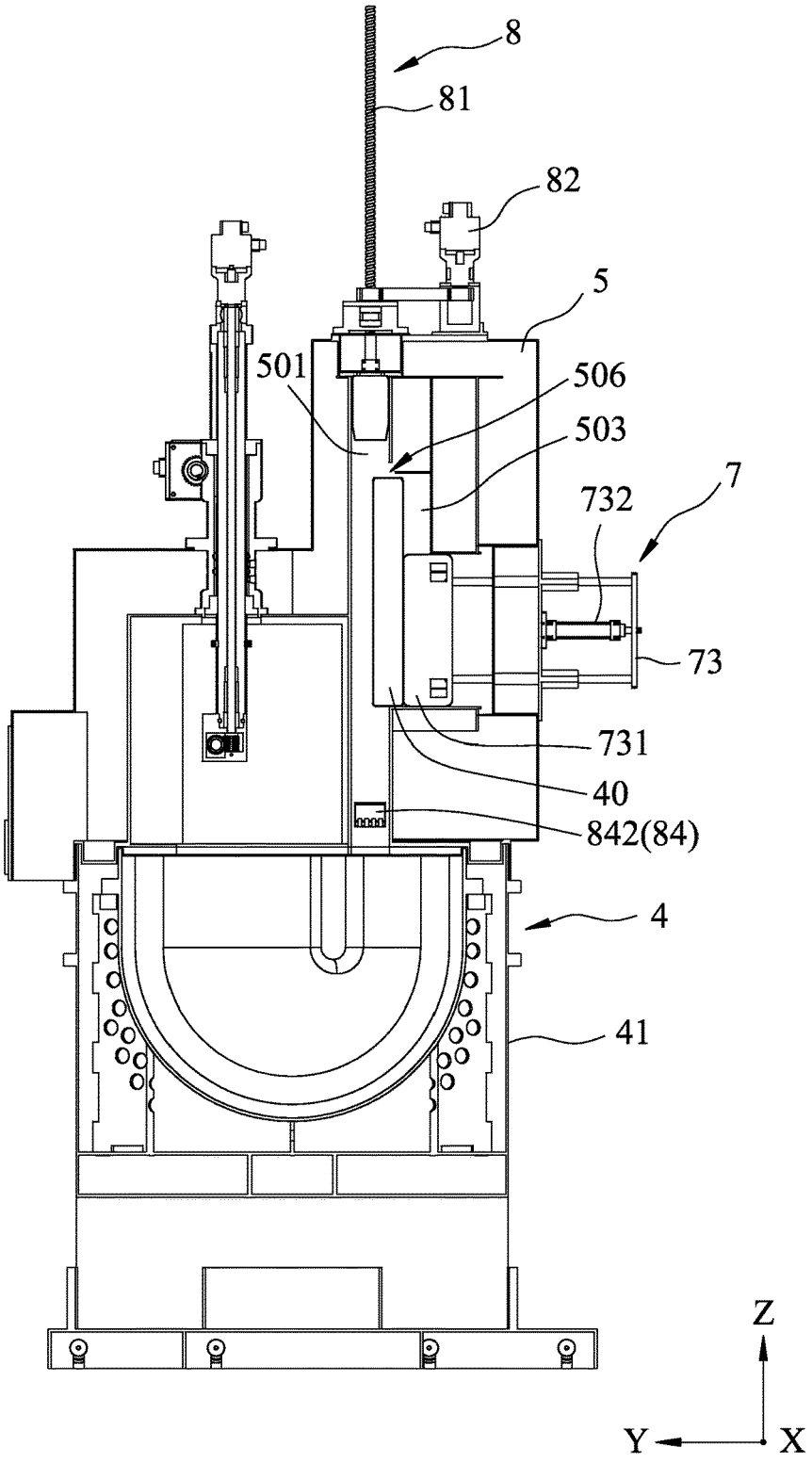
FIG. 19 is a view similar to FIG. 18, illustrating the raw material bar being transferred by the bar delivering sub-unit.

Referring to FIG. 10, the raw material bar holder 62 is disposed in the enclosure body 5 after the pre-feeding operation. The transferring unit 7 is configured to transfer the raw material bars 40 held by the raw material bar holder 62 in the access passage 502 one at a time to the feed passage 501 in a manner that the raw material bar 40 extends vertically in the feed passage 501 with the push mechanism 81 being disposed above the raw material bar 40 and with the raw material bar 40 contacting the material retainer 84. In detail, the bar moving sub-unit 71 is configured to move the raw material bars 40 held by the raw material bar holder 62 in the access passage 502 one at a time to the orientation converting sub-unit 72. Referring to FIGS. 11 and 12, the first drive member 712 of the bar moving sub-unit 71 is controlled, such as via the computerized control system (not shown), to drive the bar moving member 711 of the bar moving sub-unit 71 for moving a lowermost one of the raw material bars 40 in the casing body 621 of the raw material bar holder 62 out of the latter through the bar passage slots 6211 (see FIG. 7) and onto the orientation converting sub-unit 72. The force applied by the bar moving member 711 for moving the lowermost raw material bar 40 may be a constant force. Subsequently, the orientation converting sub-unit 72 is configured to convert the raw material bar 40 received from the bar moving sub-unit 71 from a horizontal orientation to a vertical orientation inside the bar guiding space 503 of the housing 51 of the enclosure body 5. Referring to FIG. 13, the bar guiding member 721 of the orientation converting sub-unit 72 receives the raw material bar 40 with the horizontal orientation from the bar moving sub-unit 71. Referring to FIGS. 14, 15 and 16, the second drive member 722 (see FIG. 5) of the orientation converting sub-unit 72 is controlled, such as via the computerized control system (not shown), to drive rotation of the bar guiding member 721 for converting the raw material bar 40 from the horizontal orientation to the vertical orientation inside the bar guiding space 503. The stop portion 7211 of the bar guiding member 721 is used to keep the raw material bar 40 from sliding while the latter is being converted to the vertical orientation. Thereafter, the bar delivering sub-unit 73 is configured to transfer the raw material bar 40 converted by the orientation converting sub-unit 72 to the feed passage 501. Referring to FIGS. 17, 18 and 19, the third drive member 732 of the bar delivering sub-unit 73 is controlled, such as via the computerized control system (not shown), to drive movement of the bar advancing member 731 for transferring the vertically oriented raw material bar 40 from the bar guiding space 503 to the feed passage 501 through the bar delivery hole 506. The bar delivery hole 506 is disposed below the push mechanism 81 and above the material retarder 84. In this embodiment, one cycle of operation of each of the bar moving sub-unit 71, the orientation converting sub-unit 72 and the bar delivering sub-unit 73 transfers one raw material bar 40 from the raw material bar holder 62 in the access passage 502 to the feed passage 501. In addition, operation of the orientation converting sub-unit 72 starts after operation of the bar moving sub-unit 71 is completed, and operation of the bar delivering sub-unit 73 starts after operation of the orientation converting sub-unit 72 is completed.

Figure 20:
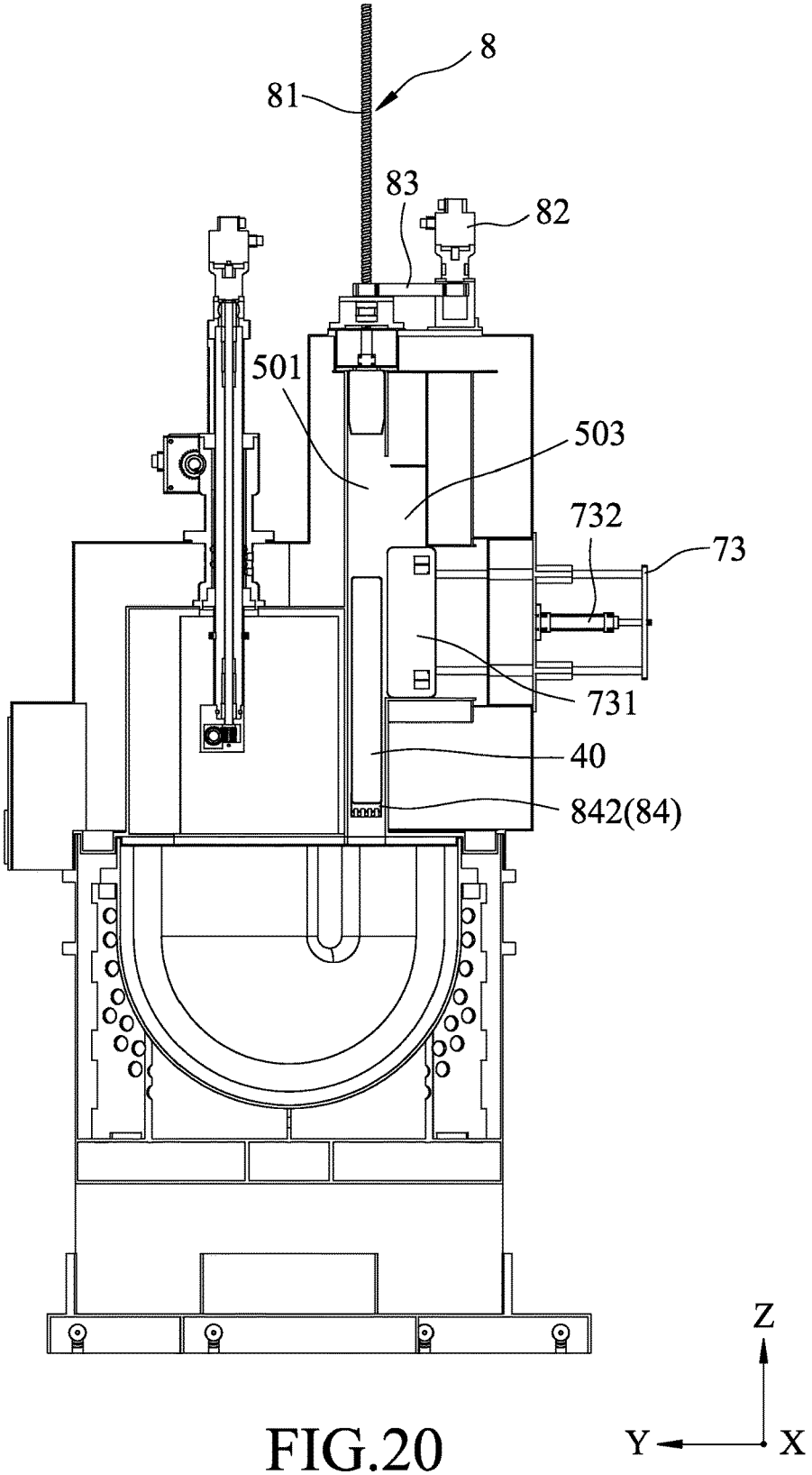
FIG. 20 is a view similar to FIG. 19, illustrating the raw material bar transferred by the bar delivering sub-unit to a feed passage.
Figure 21:
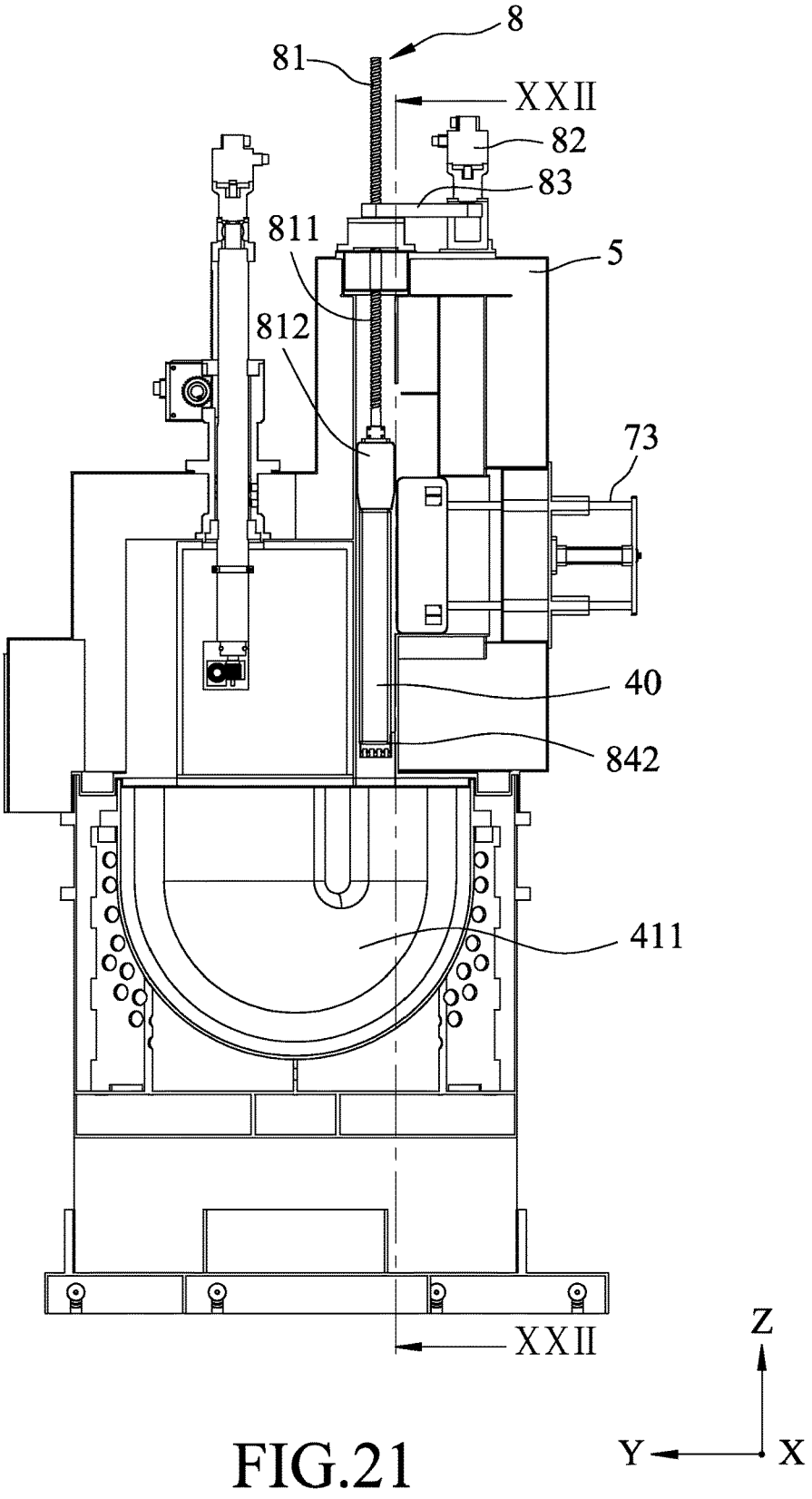
FIG. 21 is a view similar to FIG. 20, illustrating a push mechanism of the feeding unit pushing the raw material bar in the feed passage downward.
Figure 22:
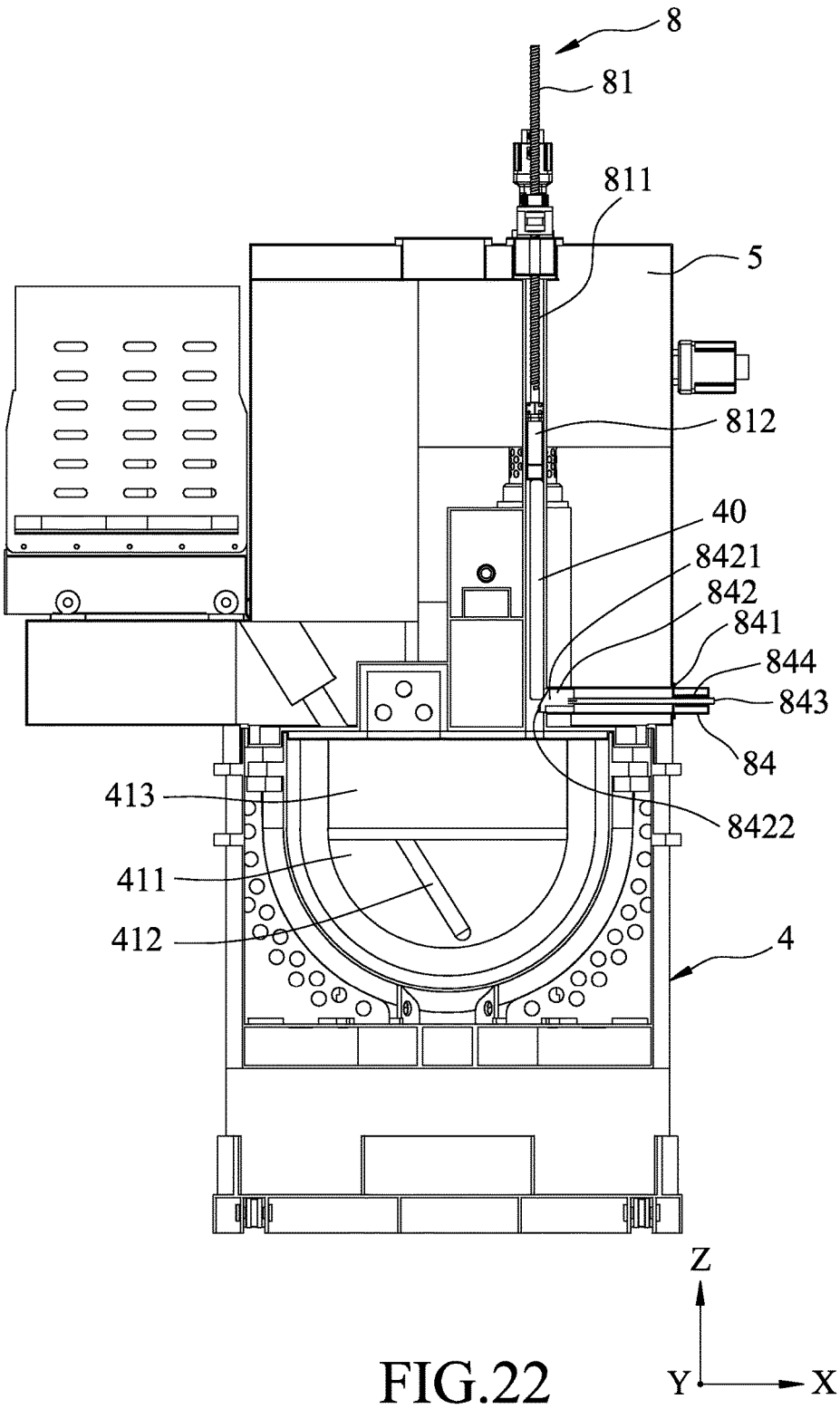
FIG. 22 is a schematic view of the embodiment, viewed from line XXII-XXII in FIG. 21, illustrating the raw material bar being restricted in the feed passage by a material retarder.
Figure 23:
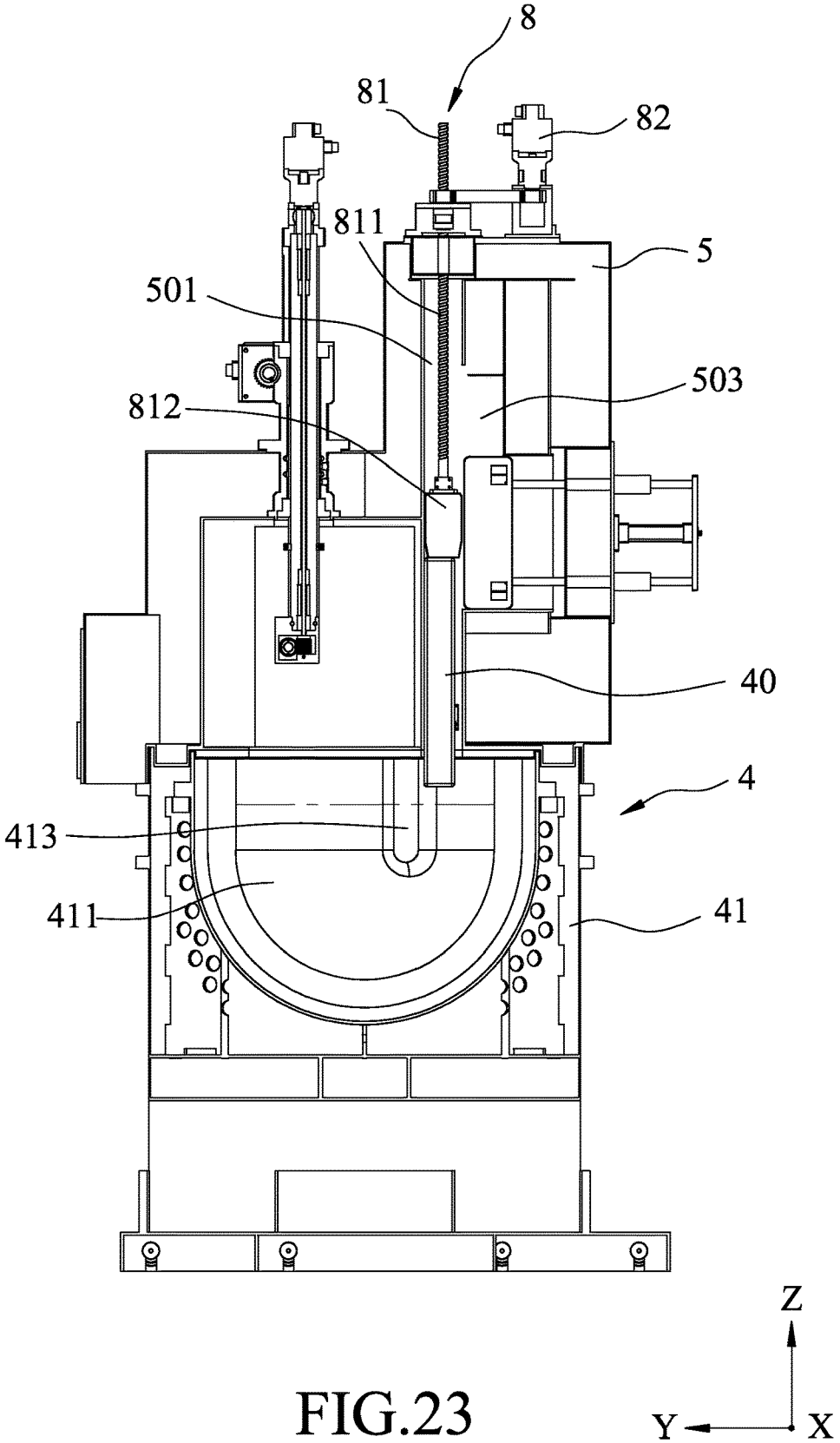
FIG. 23 is a view similar to FIG. 21, illustrating the raw material bar being pushed by the push mechanism to move past the material retarder.
Figure 24:
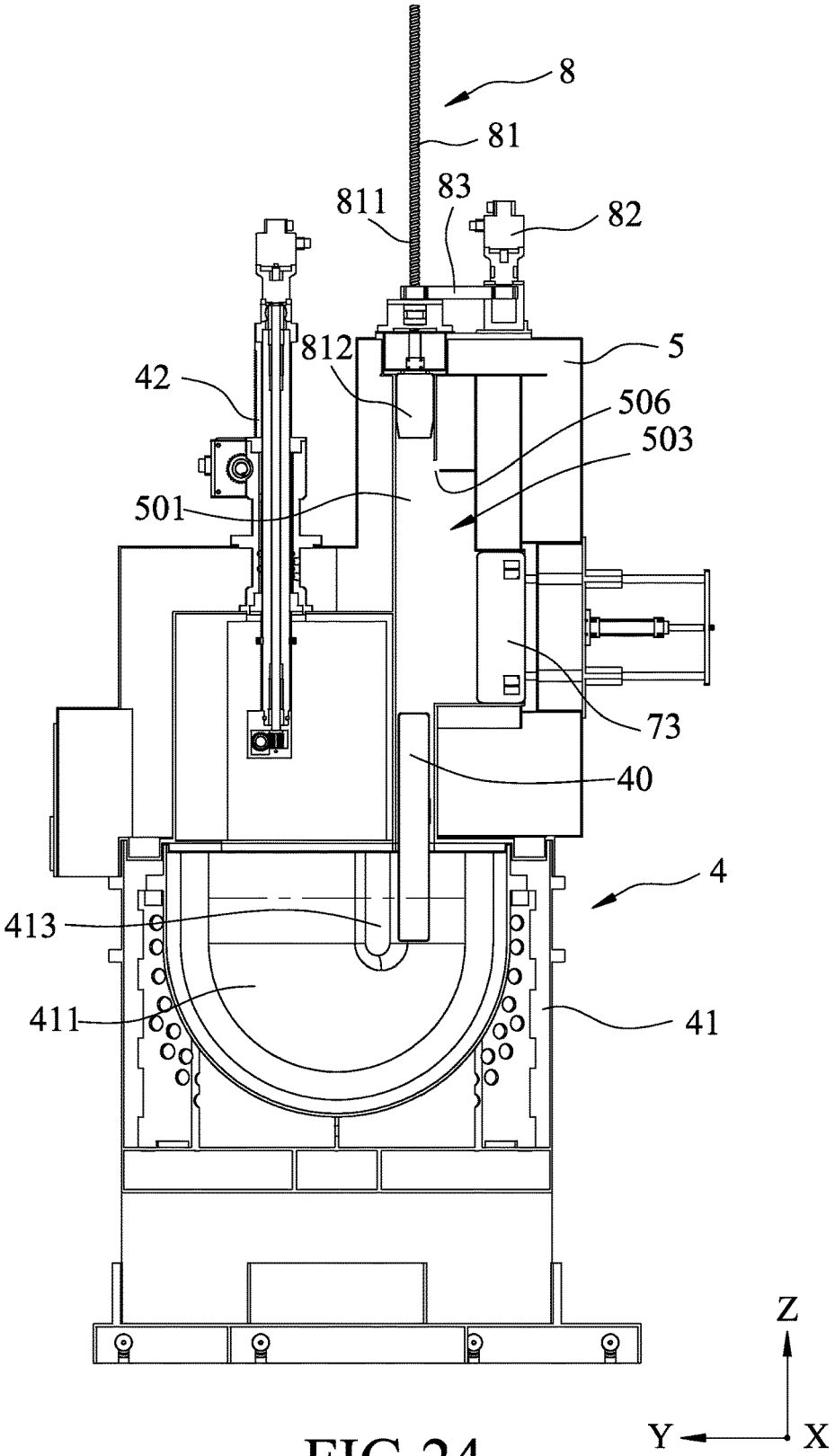
FIG. 24 is a view similar to FIG. 23, illustrating a push block segment of the push mechanism moved upward and the bar delivering sub-unit moved to a standby state.
Figure 25:
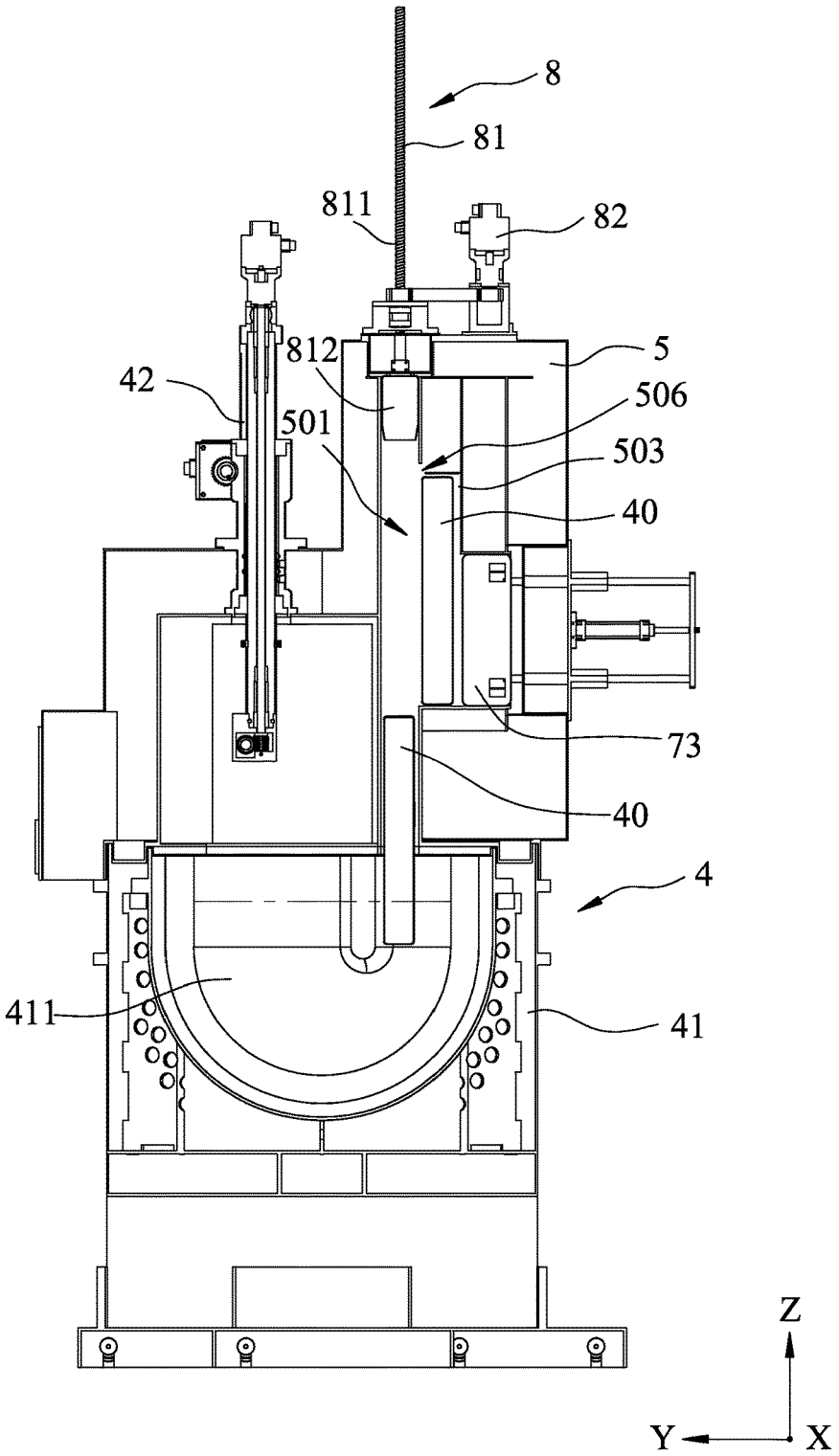
FIG. 25 is a view similar to FIG. 24, illustrating a second raw material bar to be fed into the feed passage.
Figure 26:
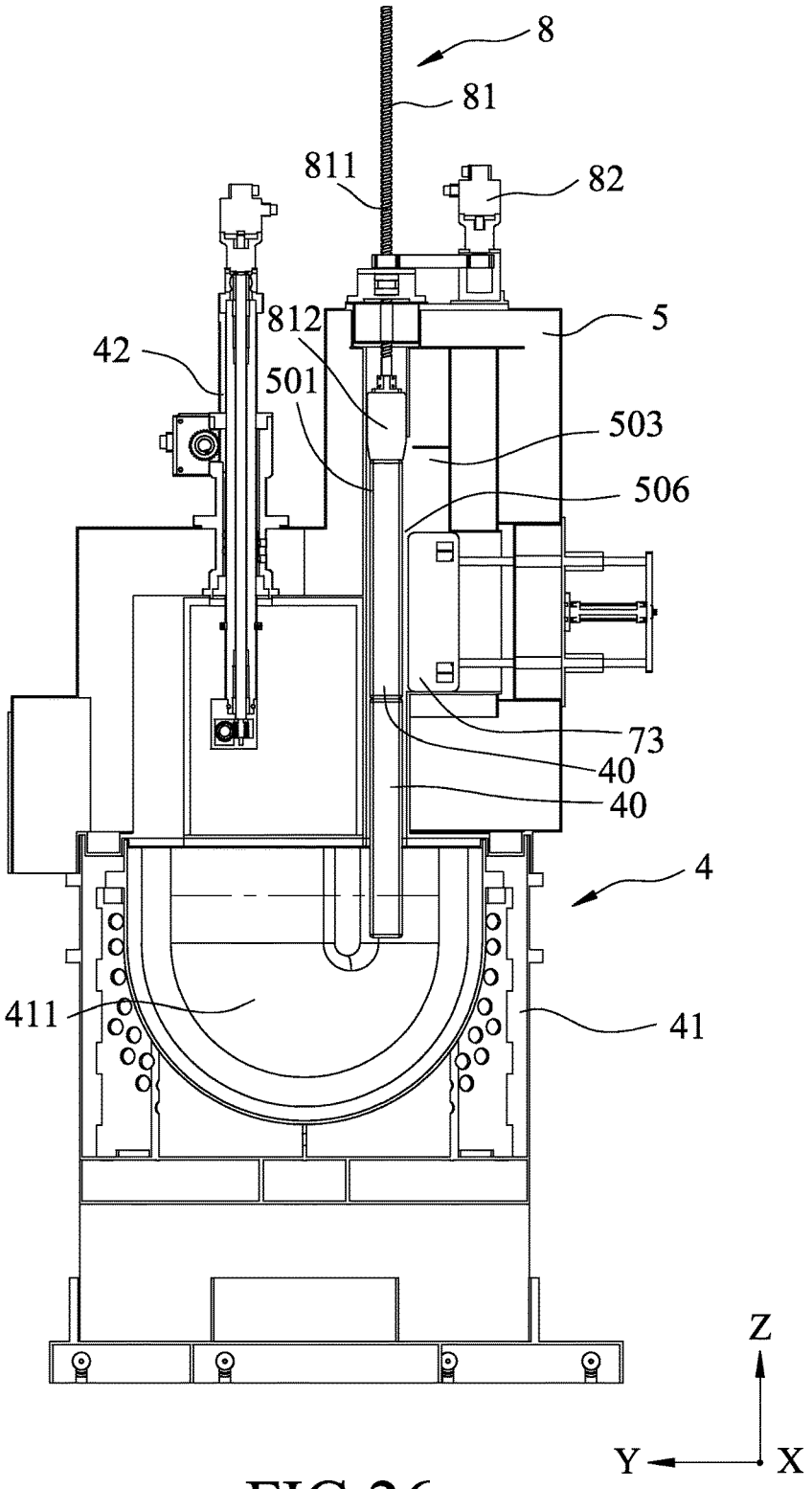
FIG. 26 is a view similar to FIG. 25, illustrating the second raw material bar transferred to the feed passage by the bar delivering sub-unit.
Figure 27:
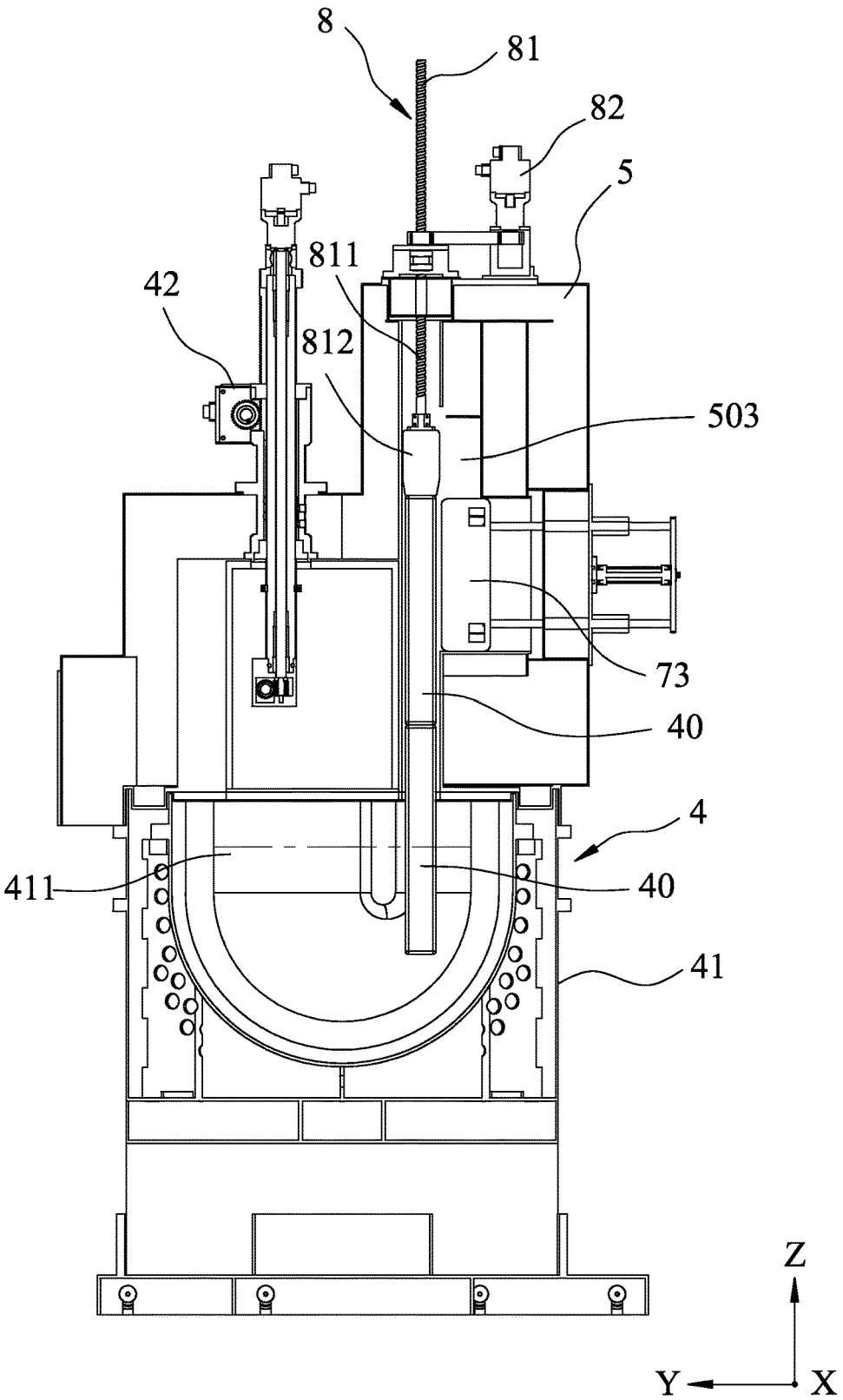
FIG. 27 is a view similar to FIG. 26, illustrating the push mechanism pushing the raw material bars in the feed passage downward to extend into the furnace body.

Referring to FIG. 20, the raw material bar 40 drops onto the blocker 842 of the material retarder 84 of the feeding unit 8 when transferred to the feed passage 501, and is thus restricted by the blocker 842 from falling directly into the furnace body 411. Referring to FIGS. 21, 22 and 23, the actuator 82 of the push mechanism 81 is controlled, such as through the computerized control system (not shown), to drive rotation of the screw rod segment 811 via the transmission belt 83 for moving the push block segment 812 downward in the Z-direction inside the feed passage 501 and pushing the raw material bar 40 in the feed passage 501 downwardly via the push block segment 812. The raw material bar 40 applies a downward pushing force on the inclined face 8421 of the blocker 842, the blocker 842 moves rearward in the X-direction, and the raw material bar 40 moves downward in the Z-direction inside the feed passage 501. The raw material bar 40 is thus moved gradually into the furnace body 411 to extend to the level of the molten material (indicated by phantom lines in FIG. 23) in the furnace body 411. Referring to FIG. 24, when the top end of the raw material bar 40 is below a bottom edge of the bar delivery hole 506, the actuator 82 is controlled, such as via the computerized control system (not shown), to drive upward movement of the push block segment 812 in the Z-direction via the transmission belt 83 and the screw rod segment 811. Referring to FIGS. 25 and 26, a second raw material bar 40 is transferred to the feed passage 501 by the transferring unit 7. Referring to FIG. 27, the actuator 82 is controlled, such as via the computerized control system (not shown), to drive downward movement of the push block segment 812 in the Z-direction via the transmission belt 83 and the screw rod segment 811, thereby pushing the second raw material bar 40 to move downward in the feed passage 501. The first raw material bar 40 is then pushed by the second raw material bar 40 to continue to move downward out of the feed passage 501 and into the furnace body 411.

As the raw material bar 40 gradually extends into the molten material in the furnace body 411, the raw material bar 40 will be heated and begins to melt. Therefore, a large drop in the temperature of the molten material can be avoided due to the gradual extension of the raw material bar 40 into the furnace body 411.

Moreover, since the downward pushing operation of the push mechanism 81 takes a relatively longer amount of time, transfer operation of a next raw material bar 40 by the transferring unit 7 can continue to ensure continuous and stable feeding of the raw material bars 40 into the furnace body 411. This may help prevent large fluctuations in the temperature of the molten material in the furnace body 411, and may reduce the need to frequently activate the heating bars 412 so as to reduce energy consumption.

When the molten material in the furnace body 411 has reached a suitable temperature and a sufficient amount, the ladle device 42 may be operated for feeding the molten material to a die casting machine (not shown).

Referring again to FIGS. 9 and 10, while the above operations are being performed, the other raw material bar holder 62 is standing by outside the housing 51 of the enclosure body 5 and may be filled with the raw material bars 40. When the raw material bars 40 in the raw material bar holder 62 inside the enclosure body 5 have been used up, the emptied raw material bar holder 62 may be moved back to the movable base 61. The movable base 61 may then be moved so that the filled raw material bar holder 62 may be moved into the access passage 502 of the housing 51 of the enclosure body 5 to continue supplying the raw material bars 40 to the feed passage 501.

Some advantages of the apparatus of the disclosure are summarized as follows:

The raw material bars 40 need not undergo preprocessing into particulate form, thereby reducing operating costs.

Through the transferring unit 7 and the feeding unit 8, the raw material bars 40 may be fed in sequence to the furnace body 411 in a continuous and stable manner.

The feeding unit 8 is able to ensure stable and gradual feeding of the raw material bars 40 to the furnace body 411. Abrupt feeding of the raw material bars 40 is prevented to avoid large fluctuations in the temperature of the molten material in the furnace body 411. This may help achieve stable quality and may reduce waiting time due to heating operations.

Another advantage of keeping the temperature of the molten material in the furnace body 411 relatively stable is that: the heating temperature of the heating bars 412 is usually higher than the melting point of the raw material bars 40. When the heating operation of the heating bars 412 is paused, the temperature of the molten material in the furnace body 411 is still sufficient to cause the raw material bars 40 to melt. Therefore, long operation time or frequent on-off operation of the heating bars 412 is not needed to result in energy savings.

The gate mechanism 53 is used to control access into the enclosure body 5 from the outside. Through the gate mechanism 53, a sealed condition inside the enclosure body 5 may be achieved during operation to prevent ambient air from causing a drop in the temperature of the heating device 41 and to prevent entry of contaminants.

The enclosure body 5 has spaces or passages in spatial communication with the furnace body 411 that permit the flow of high temperature gas for preheating the raw material bars 40 inside the enclosure body 5. This favors reduction in usage time of the heating bars 412.

Use of the movable base 61 facilitates replacement of the raw material bar holder 62 inside the enclosure body 5. While one raw material bar holder 62 is inside the enclosure body 5, another raw material bar holder 62 is standing by outside the enclosure body 5 and may be filled with the raw material bars 40. Therefore, an emptied raw material bar holder 62 may be quickly replaced with a filled raw material bar holder 62 to ensure stable feeding of the raw material bars 40 into the furnace body 411.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. An apparatus for feeding raw material bars to a furnace body of a melting furnace, said apparatus comprising:

an enclosure body provided with a feed passage that extends vertically and that is to be disposed above an open top side of the furnace body;

a feeding unit including a push mechanism that extends vertically into an upper part of the feed passage, and a material retarder that extends into a lower part of the feed passage; and a transferring unit disposed at the enclosure body and configured to transfer a raw material bar to the feed passage in a manner that the raw material bar extends vertically in the feed passage with the push mechanism being disposed above the raw material bar and with the raw material bar contacting the material retarder;

wherein the push mechanism is operable to push the raw material bar in the feed passage downwardly and the material retarder is configured to retard downward movement of the raw material bar out of the feed passage and into the furnace body;

wherein the enclosure body further has an access passage;

wherein the apparatus further comprises a carriage movable into and out of the access passage and configured to hold the raw material bars; and wherein the enclosure body further has a gate mechanism configured to selectively open and close the access passage.

2. The apparatus according to claim 1, wherein the gate mechanism includes a support, a gate member disposed movably at the support, and a pressure cylinder for driving opening and closing movement of the gate member.

3. The apparatus according to claim 1, wherein the enclosure body is formed with at least one vent hole that permits high temperature gas from the furnace body to flow into the enclosure body for preheating the raw material bars in the enclosure body.

4. The apparatus according to claim 1, wherein the transferring unit is configured to transfer the raw material bars held by the carriage in the access passage one at a time to the feed passage.

5. The apparatus according to claim 4, wherein:

the carriage is configured to hold the raw material bars in a manner that the raw material bars extend horizontally and are disposed in a stack; and the transferring unit includes a bar moving sub-unit, an orientation converting sub-unit, and a bar delivering sub-unit;

the bar moving sub-unit being configured to move the raw material bars held by the carriage in the access passage one at a time to the orientation converting sub-unit;

the orientation converting sub-unit being configured to convert the raw material bar received from the bar moving sub-unit from a horizontal orientation to a vertical orientation inside the enclosure body;

the bar delivering sub-unit being configured to transfer the raw material bar converted by the orientation converting sub-unit to the feed passage.

6. The apparatus according to claim 5, wherein the orientation converting sub-unit includes a rotatable bar guiding member disposed to receive the raw material bar with the horizontal orientation from the bar moving sub-unit, and a drive member coupled to and configured to drive rotation of the bar guiding member for converting the raw material bar received from the bar moving sub-unit from the horizontal orientation to the vertical orientation inside the enclosure body.

7. The apparatus according to claim 6, wherein the drive member is a motor.

8. The apparatus according to claim 5, wherein the bar moving sub-unit includes a bar moving member configured to move the raw material bars held by the carriage inside the access passage one at a time to the orientation converting sub-unit, and a drive member coupled to the bar moving member and operable to drive back and forth movement of the bar moving member relative to the carriage inside the access passage.

9. The apparatus according to claim 8, wherein the drive member is a pressure cylinder.

10. The apparatus according to claim 5, wherein the bar delivering sub-unit includes a bar advancing member configured to transfer the raw material bar converted to the vertical orientation by the orientation converting sub-unit to the feed passage, and a drive member coupled to the bar advancing member and operable to drive back and forth movement of the bar advancing member relative to the feed passage.

11. The apparatus according to claim 10, wherein the drive member is a pressure cylinder.

12. The apparatus according to claim 1, wherein the carriage includes at least one raw material bar holder that is configured to hold the raw material bars in a manner that the raw material bars extend horizontally and are disposed in a stack, the raw material bar holder including a casing body and a plurality of rollers mounted rotatably to the casing body for moving the raw material bar holder into and out of the access passage, the casing body having an opposing pair of casing walls, a lower part of the casing walls being formed with a registered pair of bar passage slots that extend horizontally, the bar passage slots permitting removal of a lowermost one of the raw material bars in the stack from the raw material bar holder by the transferring unit.

13. The apparatus according to claim 12, wherein the casing body has one side formed with a bar entrance opening, the raw material bar holder further including a barrier plate connected removably to the casing body for covering and uncovering the bar entrance opening, the barrier plate cooperating with the casing body to confine a receiving space for receiving the raw material bars.

14. The apparatus according to claim 12, wherein the enclosure body includes parallel guide shafts that extend horizontally and are disposed outside and adjacent to the access passage, the carriage including a movable base movably disposed on the guide shafts, and two of the raw material bar holders, the movable base having two slide grooves each of which has one of the raw material bar holders movably disposed thereat, the movable base being movable on the guide shafts to align a selected one of the slide grooves with the access passage and permit movement of one of the raw material bar holders into and out of the access passage.

15. The apparatus according to claim 1, wherein the push mechanism includes:

a vertically extending screw rod segment;

a push block segment coupled to the screw rod segment and disposed in the feed passage;

an actuator; and a transmission belt trained between the screw rod segment and the actuator;

the actuator being configured to drive rotation of the screw rod segment via the transmission belt for moving the push block segment downward in the feed passage and pushing the raw material bar in the feed passage downwardly via the push block segment.

16. The apparatus according to claim 15, wherein the actuator is a servo motor.

17. The apparatus according to claim 1, wherein the material retarder includes:

a blocker having an inclined face and a resisting part at a lower edge of the inclined face, the inclined face and the resisting part being disposed in the feed passage for contacting the raw material bar in the feed passage;

a limit cage disposed at the enclosure body;

a pair of fixing shafts, each having one end connected to the blocker and each extending slidably through the limit cage; and a pair of biasing components each sleeved on a respective one of the fixing shafts and each having opposite ends respectively abutting against the limit cage and the respective one of the fixing shafts, the biasing components biasing the fixing shafts for moving the blocker to project into the feed passage.

18. The apparatus according to claim 1, wherein the enclosure body includes a housing and a plurality of partition plates disposed in the housing, the partition plates partitioning an interior of the housing into the feed passage that is for spatial communication with the furnace body, an access passage that is for spatial communication with an exterior of the housing, a bar guiding space that is in spatial communication with the feed passage and the access passage, and a vent passage that is for spatial communication with the furnace body, at least one of the partition plates being formed with vent holes in spatial communication with the access passage and the vent passage, the vent passage and the vent holes permitting high temperature gas from the furnace body to flow into the enclosure body for preheating the raw material bar in the enclosure body.

19. The apparatus according to claim 18, wherein one of the partition plates is formed with a bar delivery hole at a junction of the bar guiding space and the feed passage, disposed below the push mechanism and above the material retarder, and configured to permit passage of the raw material bar from the bar guiding space into the feed passage.

20. The apparatus according to claim 1, wherein the transferring unit is configured to convert the raw material bar from a horizontal orientation to a vertical orientation before transferring the raw material bar to the feed passage.

* * * * *